US009182200B2

(12) United States Patent
Hunn et al.

(10) Patent No.: US 9,182,200 B2
(45) Date of Patent: Nov. 10, 2015

(54) ARMOR HAVING PRISMATIC, TESSELATED CORE

(71) Applicant: LOCKHEED MARTIN CORPORATION, Bethesda, MD (US)

(72) Inventors: David L. Hunn, Kennedale, TX (US); Kenneth W. Havens, Crowley, TX (US); Sang J. Lee, Coppell, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 14/465,059

(22) Filed: Aug. 21, 2014

(65) Prior Publication Data

US 2015/0285597 A1 Oct. 8, 2015

Related U.S. Application Data

(63) Continuation of application No. 13/382,752, filed as application No. PCT/US2009/063887 on Nov. 10, 2009, now Pat. No. 8,985,001, which is a continuation-in-part of application No.

(Continued)

(51) Int. Cl.

| | |
|---|---|
| ***B63G 9/00*** | (2006.01) |
| ***F41H 11/14*** | (2006.01) |
| ***F41H 11/12*** | (2011.01) |

(52) U.S. Cl.
CPC ..... *F41H 11/14* (2013.01); *F41H 11/12* (2013.01)

(58) Field of Classification Search
CPC ..... F41H 5/0492; F41H 5/013; F41H 5/007; F41H 5/0414; F41H 5/0428; F41H 5/023; F41H 7/02; F41H 5/0485; F41H 5/08; F41H 7/04; F41H 7/042; F41H 5/0421; F41H 5/0457; F41H 5/04; F41H 5/0407; F41H 1/02; F41H 7/044; F41H 5/24
USPC ..... 89/36.01–36.17
See application file for complete search history.

(56) References Cited

U.S. PATENT DOCUMENTS

| | | | | |
|---|---|---|---|---|
| 3,380,406 | A * | 4/1968 | Gosnell | 109/80 |
| 3,380,408 | A | 4/1968 | Gosnell | |

(Continued)

FOREIGN PATENT DOCUMENTS

| | | |
|---|---|---|
| DE | 4005904 | 8/1991 |
| DE | 102006050130 | 4/2008 |

(Continued)

*Primary Examiner* — Samir Abdosh
(74) *Attorney, Agent, or Firm* — Terry M. Sanks, Esq.; Beusse Wolter Sanks & Maire, PLLC

(57) ABSTRACT

An armor includes a core that, in turn, includes a first layer of prismatic elements arranged in a tessellated fashion and a second layer of prismatic elements arranged in a tessellated fashion. The first layer of prismatic elements is nested into the second layer of prismatic elements. An armor includes a strike face sheet, a rear face sheet, and a core disposed between the strike face sheet and the rear face sheet. The core includes a first layer of prismatic elements arranged in a tessellated fashion, a second layer of prismatic elements arranged in a tessellated fashion, and a strain isolation layer. The first layer of prismatic elements is nested into the second layer of prismatic elements with the strain isolation layer disposed between the first layer of prismatic elements and the second layer of prismatic elements. The armor is at least one of curved in at least one direction, configured to include a corner, and configured to include a prismatic element of the first layer of prismatic elements or the second layer of prismatic element having a metallic layer disposed thereon.

19 Claims, 13 Drawing Sheets

Related U.S. Application Data

PCT/US2009/050005, filed on Jul. 9, 2009.

(60) Provisional application No. 61/150,880, filed on Feb. 9, 2009, provisional application No. 61/150,870, filed on Feb. 9, 2009, provisional application No. 61/082,757, filed on Jul. 22, 2008.

(56) References Cited

U.S. PATENT DOCUMENTS

| | | | | |
|---|---|---|---|---|
| 4,566,237 | A | 1/1986 | Turner | |
| 4,662,288 | A * | 5/1987 | Hastings et al. | 109/2 |
| 5,221,807 | A * | 6/1993 | Vives | 89/36.02 |
| 5,577,432 | A | 11/1996 | Becker et al. | |
| 5,804,757 | A | 9/1998 | Wynne | |
| 6,418,832 | B1 | 7/2002 | Colvin | |
| 6,531,212 | B2 * | 3/2003 | Owusu et al. | 428/323 |
| 6,575,075 | B2 * | 6/2003 | Cohen | 89/36.02 |
| 6,758,125 | B1 | 7/2004 | Zank | |
| 7,540,229 | B2 | 6/2009 | Seo et al. | |
| 7,546,796 | B2 | 6/2009 | Hunn | |
| 8,096,223 | B1 * | 1/2012 | Andrews | 89/36.02 |
| 8,985,001 | B2 * | 3/2015 | Hunn et al. | 89/36.02 |
| 2004/0050239 | A1 | 3/2004 | Benyami et al. | |
| 2006/0266207 | A1 | 11/2006 | Cerny et al. | |
| 2007/0283801 | A1 | 12/2007 | Gallo | |
| 2008/0307553 | A1 * | 12/2008 | Jbeili et al. | 2/2.5 |
| 2009/0078109 | A1 * | 3/2009 | Baxter et al. | 89/36.02 |
| 2010/0043630 | A1 * | 2/2010 | Sayre et al. | 89/36.02 |
| 2011/0107904 | A1 * | 5/2011 | Queheillalt et al. | 89/36.02 |
| 2011/0283873 | A1 * | 11/2011 | Wadley et al. | 89/36.02 |
| 2012/0174759 | A1 * | 7/2012 | Gallo et al. | 89/36.02 |
| 2013/0263727 | A1 * | 10/2013 | O'Masta et al. | 89/36.02 |
| 2013/0284005 | A1 * | 10/2013 | Grozdanich et al. | 89/36.02 |

FOREIGN PATENT DOCUMENTS

| | | |
|---|---|---|
| EP | 1985961 | 10/2008 |
| WO | 2009061539 | 5/2009 |

* cited by examiner

ARMOR HAVING PRISMATIC, TESSELATED CORE

CROSS REFERENCE TO RELATED APPLICATIONS

This is a Continuation of U.S. application Ser. No. 13/382,752 filed Feb. 2, 2012, which is a 371 of PCT/US2009/63887 filed Nov. 10, 2009, which is a Continuation-In-Part of PCT/US2009/50005 filed Jul. 9, 2009, which claims the benefit of U.S. Provisional Nos. 61/150,880, 61/150,870 and 61/082,757 filed Feb. 9, 2009, Feb. 9, 2009 and Jul. 22, 2008, respectively, and incorporated herein by reference in their entirety.

TECHNICAL FIELD

The present invention relates to armor.

DESCRIPTION OF THE PRIOR ART

In combat situations, such as in military, police, and/or armored transport operations, it is desirable to protect vehicles, such as tanks, personnel carriers, trucks, aircraft, and the like, as well as the vehicle's contents, from damage by enemy fire. Accordingly, such vehicles are known to include armor to reduce the likelihood that ballistic rounds, shaped charge jets, explosively-formed penetrators, or other such projectiles will penetrate the vehicle. If the rounds penetrate the vehicle, the occupants of the vehicle may be injured or the vehicle's ability to operate may be impaired. It is also desirable to protect individual persons from damage by enemy fire. Personal body armor is typically worn as an external vest or covering and is designed to defeat a number of threats that may be encountered in the field.

To meet agility and performance requirements, however, it is desirable to minimize the mass fraction of the basic structure of such a vehicle or personal body armor. When ballistic protection is needed in such a vehicle, the addition of conventional armor significantly increases the overall mass of the vehicle, impacting performance and transportability characteristics of the vehicle. Similarly, the use of conventional body armor increases the weight that a person must carry and/or decreases the amount of weight in arms and the like that a person may carry. Conventional ballistic armor typically relies upon layering outer hard ceramic elements with inner spall liners. While mass efficient, such armors suffer from only single shot effectiveness. In other words, such an armor is effective if a single ballistic round strikes the armor in a particular location. If a second round, however, strikes the armor in generally the same location as the first round, the armor is often ineffective in stopping the second ballistic round. Conventional ballistic armor is also typically expensive to manufacture, as such armors are made from custom ceramic plates made of exotic ceramics, such as boron carbide.

Conventional personal body armor typically consists of a single ceramic plate inserted into the vest or covering to provide ballistic protection. This single plate is prone to breakage from normal handling and, if broken, its ballistic properties are severely compromised.

There are many designs of ballistic armor well known in the art; however, considerable shortcomings remain.

BRIEF DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
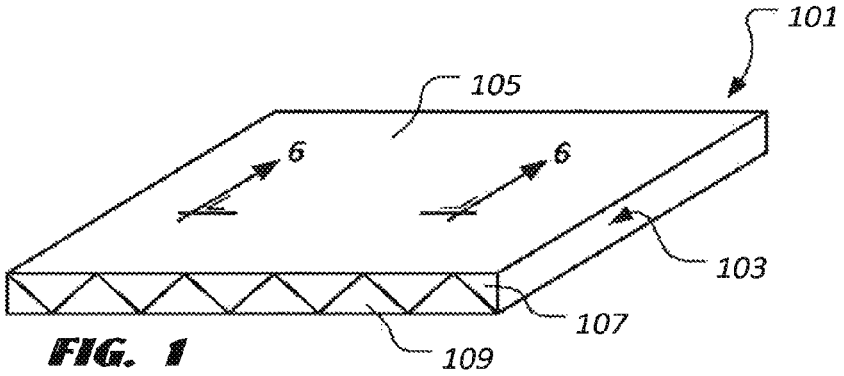
FIG. 1 is a perspective view of a first illustrative embodiment of an armor.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

The present invention represents a ballistic armor having a prismatic, tessellated core. The core comprises a plurality of layers of tessellated, prismatic elements. The layers of tessellated, prismatic elements are separated from one another by strain isolation layers. The prismatic elements are arranged such that faces of prismatic elements in adjacent layers of prismatic elements, separated by the strain isolation layer, are in facing, nested relationships to one another. The ballistic armor further includes a strike face sheet and a rear face sheet, such that the core is disposed between the strike face sheet and the rear face sheet. In certain embodiments, the ballistic armor further includes a viscoelastic layer disposed between the core and the strike face sheet and/or a viscoelastic layer disposed between the core and the rear face sheet. In some embodiments, one or more of the prismatic elements defines at least one cavity or recess in which an explosive grain is disposed. Furthermore, in some embodiments, at least one of the prismatic elements is not opaque, i.e., has some degree of transparency or translucency.

Figure 2:
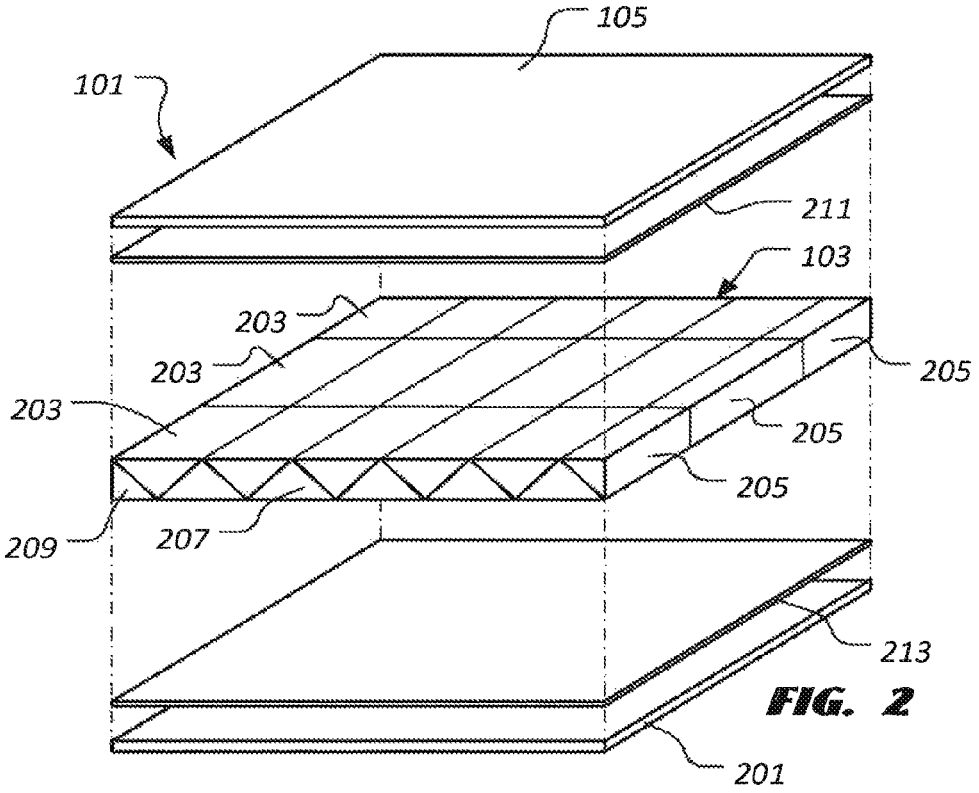
FIG. 2 is a partially exploded, perspective view of the armor embodiment of FIG. 1.

FIG. 1 depicts a perspective view of an illustrative embodiment of an armor 101. FIG. 2 depicts an exploded, perspective view of the embodiment of armor 101 shown in FIG. 1. In the illustrated embodiment, armor 101 comprises a core 103 disposed between a strike face sheet 105 and a rear face sheet 201. Strike face sheet 105 comprises a material that will, to some degree, substantially impede the progress of a ballistic projectile. For example, in various embodiments, strike face sheet 105 comprises titanium; a titanium alloy; aluminum; an aluminum alloy; an organic-matrix composite material, such as, for example, graphite-, carbon-, aramid-para-aramid-, ultra high molecular weight polyethylene- or fiberglass-reinforced epoxy composite material; a metal-matrix composite material, such as carbon-, silicon carbide-, or boron-reinforced titanium or aluminum composite material; a laminated material, such as titanium/aluminum laminate; a nanomaterial, such as fiberglass with nanocarbon fibers; or the like. Preferably, strike face sheet 105 comprises titanium; a titanium alloy; aluminum; an aluminum alloy; an organic-matrix composite material, such as, for example, graphite-, carbon-, or fiberglass-reinforced epoxy composite material; a laminated material, such as titanium/aluminum laminate; or the like.

Preferably, rear face sheet 201 comprises a material that will significantly reduce the velocity of spall (e.g., projectile fragments, fragments of armor 101, or the like) exiting armor 101. More preferably, rear face sheet 201 comprises a material that will substantially prevent such spa II from exiting armor 101. For example, in various embodiments, rear face sheet 201 comprises one of the materials disclosed above of which strike face sheet 105 is comprised. Preferably, rear face sheet 201 comprises titanium; a titanium alloy; aluminum; an aluminum alloy; an organic-matrix composite material, such as, for example, graphite-, carbon-, aramid-, para-aramid-, ultra high molecular weight polyethylene- or fiberglass-reinforced epoxy composite material; a laminated material, such as titanium/aluminum laminate; a nanomaterial, such as fiberglass with nanocarbon fibers; or the like. It should be noted, however, that the particular compositions of strike face sheet 105 and rear face sheet 201 are implementation specific. Accordingly, the present invention contemplates strike face sheets (e.g., strike face sheet 105) and spall liners or rear face sheets (e.g. rear face sheet 201) comprising any material suitable for a particular implementation. Moreover, the thicknesses of strike face sheets (e.g., strike face sheet 105) and spall liners or rear face sheets (e.g. rear face sheet 201) are implementation specific, depending upon the ballistic threat. In one embodiment, the thickness of strike face sheet 105 is about 0.09 inches and the thickness of rear face sheet 201 is about 0.75 inches. Generally, it is usually, but not always, desirable for rear face sheet 201 to be thicker than strike face sheet 105.

It should be noted that in embodiments wherein prismatic elements 203, 205, 207, and 209, which are discussed in greater detail herein, exhibit some degree of transparency or translucency, it may be desirable for strike face sheet 105 and/or rear face sheet 201 to also exhibit some degree of transparency or translucency. Accordingly, strike face sheet 105 and/or rear face sheet 201 comprises, in certain embodiments, a glass, such as borosilicate or aluminosilicate glass or the like; ceramic-glass, such as sapphire, spine!, aluminum oxynitride, or the like; glass-like; or polymeric material, such as polycarbonate, acrylic, or the like, that exhibit some degree of transparency. Note that glass materials may comprise a laminated construction using, for example, polyvinyl butyral, polyurethane, ethylene-vinyl acetate, or the like as laminating bonding agents.

Core 103 comprises a plurality of layers 107 and 109 of tessellated, prismatic elements 203, 205, 207, and 209. Prismatic elements 203, 205, 207, and 209 may comprise various different ceramic, glass, glass-ceramic, or glass-like materials, even within the same armor 101. Thus, prismatic elements 203, 205, 207, and 209 may exhibit various degrees of transparency. For example, prismatic elements 203, 205, 207, and 209 may be opaque, translucent, semi-transparent, generally transparent, substantially transparent, transparent, and so forth. Exemplary ceramic materials include, but are not limited to, aluminum oxide, silicon carbide, boron carbide, silicon nitride, silicon aluminumoxynitride, or the like. In certain embodiments, prismatic elements 203, 205, 207, and 209 comprise aluminum oxide, as aluminum oxide is generally lower in cost than other ceramic materials. Prismatic elements 203, 205, 207, and 209 may comprise, for example, any of the materials that exhibit some degree of transparency or translucency discussed herein as being suitable for strike face sheet 105 and/or rear face sheet 201.

Still referring to FIGS. 1 and 2, prismatic elements 203 and 205 make up layer 107, while prismatic elements 207 and 209 make up layer 109. Layers 107 and 109 are separated by a strain isolation layer 601, shown in FIG. 6 and described in greater detail herein. In certain embodiments, armor 101 comprises a first viscoelastic layer 211, disposed between core 103 and strike face sheet 105, and/or a second viscoelastic layer 213, disposed between core 103 and rear face sheet 201. In other embodiments, viscoelastic layers 211 and 213 are omitted from armor 101. Viscoelastic layers 211 and 213 are made of one or more viscoelastic materials. For the purposes of this disclosure, the term "viscoelastic" means the exhibition of both elastic and viscous properties that are demonstrable in response to mechanical shear. Preferably, viscoelastic layers 211 and 213 comprise materials such as, for example, polyurethane, polysulfide polymer, natural rubber, silicone rubber, a synthetic rubber, or the like, or a combination of such materials. The viscoelastic layers attenuate the shock wave that travels through armor 101 upon impact by a ballistic projectile, which improves the overall ballistic efficiency. Additionally, these layers constrain and bond the prismatic elements together to inhibit prismatic elements 203, 205, 207, and 209 from becoming dislodged during use. If a viscoelastic material is not used, such as for cost savings, then a typical bonding agent can be used, such as epoxy, polysulfide, or the like.

It should be noted that in embodiments wherein one or more prismatic elements 203, 205, 207, and 209 are not opaque, i.e., exhibit some degree of transparency or translucency, and one or both of strike face sheet 105 and rear face sheet 201 also are not opaque, it is desirable, but not required, that one or both of viscoelastic layers 211 and 213 also exhibit some degree of transparency or translucency. In such embodiments, it is preferable that viscoelastic layers 211 and 213 exhibit refractive indices corresponding to the material comprising the non-opaque prismatic elements 203, 205, 207, and 209. Examples of materials comprising such viscoelastic layers 211 and 213 include, but are not limited to, polyurethane, acrylic, polycarbonate, epoxy, and the like.

Figure 3:
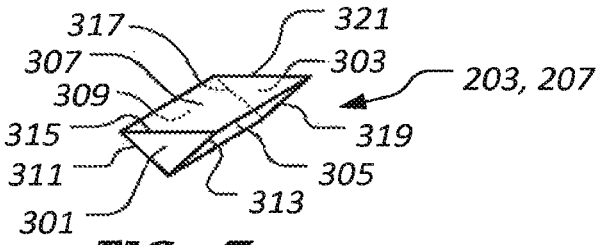
FIGS. 3 and 4 are perspective views of illustrative embodiments of prismatic elements of the armor embodiment of FIG. 1.

FIG. 3 depicts an illustrative embodiment of prismatic elements 203 and 207. For the purposes of this disclosure, the term "prismatic element" means a three-dimensional element having a first base, a second base, and a plurality of faces extending therebetween. In the embodiment of FIG. 3, prismatic elements 203 and 207 include a first base 301, a second base 303, and a plurality of faces 305, 307, and 309 extending therebetween. First base 301 and second base 303, as well as other such corresponding bases, are closed, planar figures bounded by substantially straight and/or curved edges. In the embodiment of FIG. 3, first base 301 is a closed, planar figure bounded by substantially straight edges 311, 313, and 315. Second base 303 is a closed, planar figure bounded by substantially straight edges 317, 319, and 321.

Figure 4:
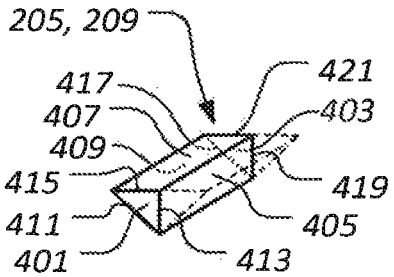

FIG. 4 depicts an illustrative embodiment of prismatic elements 205 and 209. Prismatic elements 205 and 209 are truncated portions of prismatic elements 203 and 207. In the embodiment of FIG. 4, prismatic elements 205 and 209 take on the form of substantially half of prismatic elements 203 and 207, although other configurations are contemplated by the present invention. It should be noted that the omitted portion of prismatic element 203 or 207 is shown in phantom in FIG. 4. In the illustrated embodiment, prismatic elements 205 and 209 include a first base 401, a second base 403, and a plurality of faces 405, 407, and 409 extending therebetween. First base 401 and second base 403 are closed, planar figures bounded by substantially straight and/or curved edges. In the embodiment of FIG. 4, first base 401 is a closed, planar figure bounded by substantially straight edges 411, 413, and 415. Second base 403 is a closed, planar figure bounded by substantially straight edges 417, 419, and 421.

Figure 5:
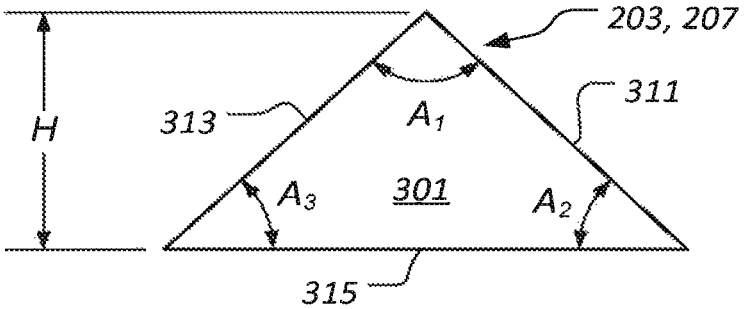
FIG. 5 is an end, elevational view of the prismatic element of FIG. 3.

As shown in FIG. 5, first base 301 of prismatic elements 203 and 207, as well as second base 303, is a triangle in the illustrated embodiment. Edges 311 and 313 define an angle A1, edges 311 and 315 define an angle A2, and edges 313 and 315 define an angle A3. In one preferred embodiment, first base 301, as well as second base 303, is an isosceles triangle, such that angle A2 is substantially equal to angle A3. In one particular embodiment, angles A2 and A3 are about 45 degrees and angle A1 is about 90 degrees. As discussed herein, prismatic elements 205 and 209 are truncated portions of prismatic elements 203 and 207. Accordingly, prismatic elements 205 and 209 have configurations that correspond to the portions of prismatic elements 203 and 207 that are common to prismatic elements 205 and 209. A height H of prismatic elements 203, 205, 207, and 209 is implementation specific, depending upon the ballistic threat. In one embodiment, height H is about 0.75 inches and, in another embodiment, height H is about 0.5 inches.

It should be noted that prismatic elements 203, 205, 207, and 209 are merely exemplary of the many, various prismatic elements contemplated by the present invention. Other forms of prismatic elements are described herein, such as the prismatic elements of the embodiments shown in FIGS. 7-16.

Figure 6:
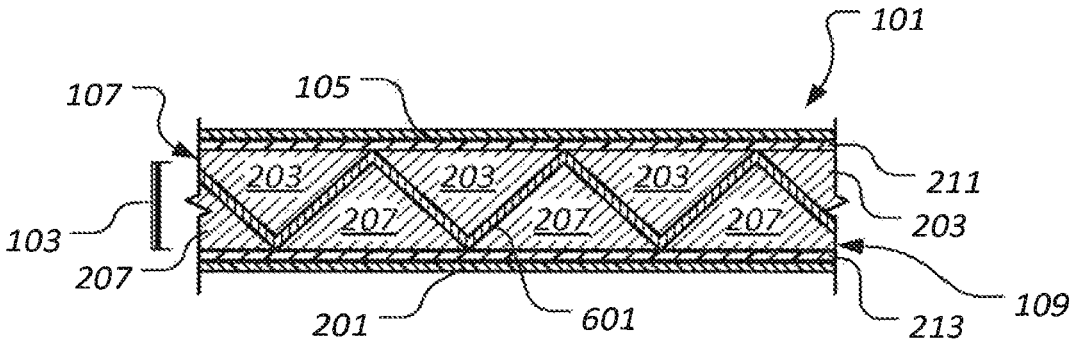
FIG. 6 is a cross-sectional view of a portion of the armor embodiment of FIG. 1, taken along the line 6-6 in FIG. 1.

FIG. 6 depicts a cross-sectional view of the embodiment of armor 101 shown in FIG. 1, taken along the line 6-6 in FIG. 1. As discussed herein in relation to FIG. 2, core 103 is disposed between strike face sheet 105 and rear face sheet 201. In some but not all embodiments, viscoelastic layer 211 is disposed between core 103 and strike face sheet 105 and viscoelastic layer 213 is disposed between core 103 and rear face sheet 201. Core 103 comprises first layer 107 of prismatic elements 203 and 205 and second layer 109 of prismatic elements 207 and 209. As noted herein, strain isolation layer 601 is disposed between first layer 107 and second layer 109. Strain isolation layer 601 impedes shock waves and the like from being propagated from first layer 107 to second layer 109. Rather than transmitting such shock waves to second layer 109, strain isolation layer 601 elastically, and in some situations viscoelastically, deforms to absorb shock wave energy that would otherwise propagate into second layer 109. Preferably, strain isolation layer 601 comprises a material such as, for example, polyurethane, polysulfide polymer, natural rubber, silicone rubber, a synthetic rubber, or the like, or a combination of such materials.

It should be noted that in embodiments wherein one or more prismatic elements 203, 205, 207, and 209 are not opaque, i.e., exhibit some degree of transparency or translucency, it is desirable, but not required, that strain isolation layer 601 also exhibit some degree of transparency or translucency. In such embodiments, it is preferable that strain isolation layer 601 exhibit a refractive index corresponding to the material comprising the non-opaque prismatic elements 203, 205, 207, and 209. Examples of materials comprising strain isolation layer 601 include, but are not limited to, polyurethane, acrylic, polycarbonate, epoxy, and the like.

In certain embodiments, viscoelastic layer 211, viscoelastic layer 213, and/or strain isolation layer 601 adhesively bond adjacent members. For example, viscoelastic layer 211 adhesively bonds strike face sheet 105 to layer 107 of prismatic elements 203 and 205. Viscoelastic layer 213, in some embodiments, adhesively bonds rear face sheet 201 to layer 109 of prismatic elements 207 and 209. Strain isolation layer 601, in some embodiments, adhesively bonds layer 107 of prismatic elements 203 and 205 to layer 109 of prismatic elements 207 and 209. In other embodiments, however, adjacent members are adhesively bonded to one another via a separate bonding agent. In other embodiments, adjacent members are not adhesively bonded to one another.

As noted herein, the prismatic elements making up a layer of prismatic elements are configured in a tessellated fashion. For example, prismatic elements 203 and 205 (shown in FIG. 2) of layer 107 (shown in FIG. 1) and prismatic elements 207 and 209 (shown in FIG. 2) of layer 109 (shown in FIG. 1) are configured in a tessellated fashion. For the purposes of this disclosure, the term "tessellated" means the prismatic elements are arranged such that no significant gap exists between prismatic elements within a layer and no adjacent prismatic elements within a layer overlap one another. In other words, the projected surface area of armor 101 is completely covered with no significant gaps by prismatic elements and there is no direct gap between prismatic elements through the thickness of core 103. A "significant gap," as recited herein, is deemed to be a gap greater than that resulting from manufacturing tolerances.

Figure 7:
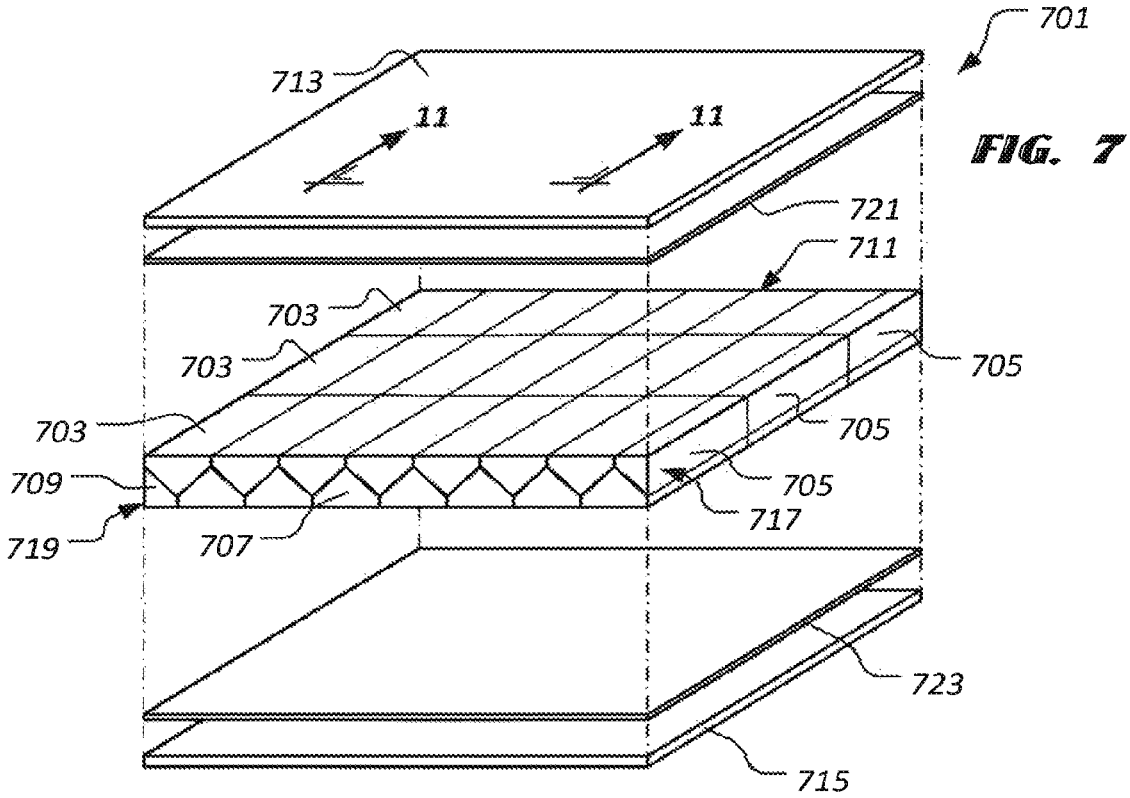
FIG. 7 is a partially exploded, perspective view of a second illustrative embodiment of an armor.

FIG. 7 depicts an exploded view of a second illustrative embodiment of an armor 701. The configuration of armor 701 corresponds to the configuration of armor 101 (shown in FIG. 1) except for the configurations of prismatic elements 703, 705, 707, and 709, of which a core 711 of armor 701 is comprised. In the illustrated embodiment, armor 701 comprises core 711 disposed between a strike face sheet 713 and a rear face sheet 715. As in the first embodiment, strike face sheet 713 comprises a material that will, to some degree, substantially impede the progress of a ballistic projectile. The materials discussed herein as being suitable or preferred for strike face sheet 105 (shown in at least FIGS. 1 and 2) are also suitable or referred for strike face sheet 713. Preferably, rear face sheet 715 comprises a material that significantly reduces the velocity of spall (e.g., projectile fragments, fragments of armor 701, or the like) exiting armor 701. More preferably, rear face sheet 715 comprises a material that will substantially prevent such spall from exiting armor 701. The materials discussed herein as being preferred for rear face sheet 201 (shown in at least FIG. 2) are also preferred for rear face sheet 715. It should be noted, however, that the particular compositions of strike face sheet 713 and rear face sheet 715 are implementation specific. Accordingly, other materials for strike face sheets, such as strike face sheet 713, and for rear face sheets, such as rear face sheet 715, are contemplated by the present invention.

Core 711 comprises a plurality of layers 717 and 719 of tessellated, prismatic elements 703, 705, 707, and 709. Prismatic elements 703, 705, 707, and 709 may comprise various different materials, even with in the same armor 701. The materials disclosed herein as being suitable for prismatic elements 203, 205, 207, and 209 (shown in at least FIG. 2) are also suitable for prismatic elements 703, 705, 707, and 709. Prismatic elements 703 and 705 make up layer 717, while prismatic elements 707 and 709 make up layer 719. Layers 717 and 719 are separated by a strain isolation layer 1101, shown in FIG. 11 and described in greater detail herein. In certain embodiments, armor 701 comprises a first viscoelastic layer 721, disposed between core 711 and strike face sheet 713, and/or a second viscoelastic layer 723, disposed between core 711 and rear face sheet 715. In other embodiments, viscoelastic layers 721 and 723 are omitted from armor 701. The materials discussed herein as being suitable or preferred for viscoelastic layers 211 and 213 are also suitable or preferred for viscoelastic layers 721 and 723.

Figure 8:
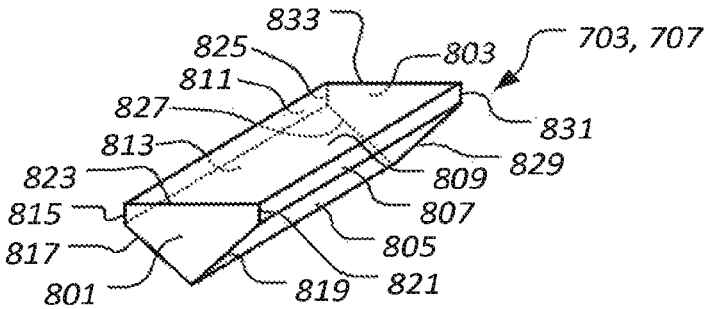
FIGS. 8 and 9 are perspective views of illustrative embodiments of prismatic elements of the armor embodiment of FIG. 7.

FIG. 8 depicts an illustrative embodiment of prismatic elements 703 and 707. In the embodiment of FIG. 8, prismatic elements 703 and 707 include a first base 801, a second base 803, and a plurality of faces 805, 807, 809, 811, and 813 extending therebetween. First base 801 and second base 803, as well as other such corresponding bases, are closed, planar figures bounded by substantially straight and/or curved edges. In the embodiment of FIG. 8, first base 801 is a closed, planar figure bounded by substantially straight edges 815, 817, 819, 821, and 823 Second base 803 is a closed, planar figure bounded by substantially straight edges 825, 827, 829, 831, and 833.

Figure 9:
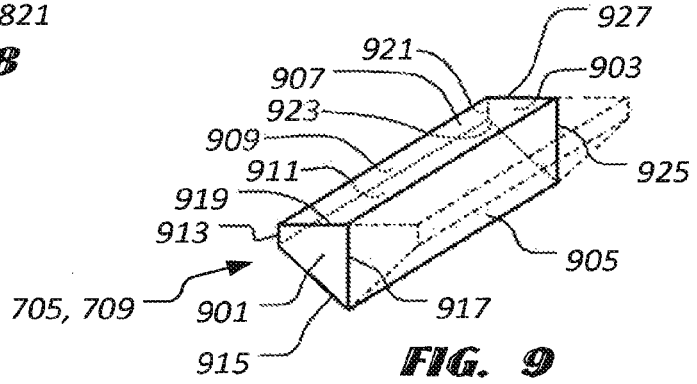

FIG. 9 depicts an illustrative embodiment of prismatic elements 705 and 709. Prismatic elements 705 and 709 are truncated portions of prismatic elements 703 and 707. In the embodiment of FIG. 9, prismatic elements 705 and 709 take on the form of substantially half of prismatic elements 703 and 707, although other configurations are contemplated by the present invention. It should be noted that the omitted portion of prismatic element 703 or 707 is shown in phantom in FIG. 9. In the illustrated embodiment, prismatic elements 705 and 709 include a first base 901, a second base 903, and a plurality of faces 905, 907, 909, and 911 extending therebetween. First base 901 and second base 903 are closed, planar figures bounded by substantially straight and/or curved edges. In the embodiment of FIG. 9, first base 901 is a closed, planar figure bounded by substantially straight edges 913, 915, 917, and 919. Second base 903 is a closed, planar figure bounded by substantially straight edges 921, 923, 925, and 927.

Figure 10:
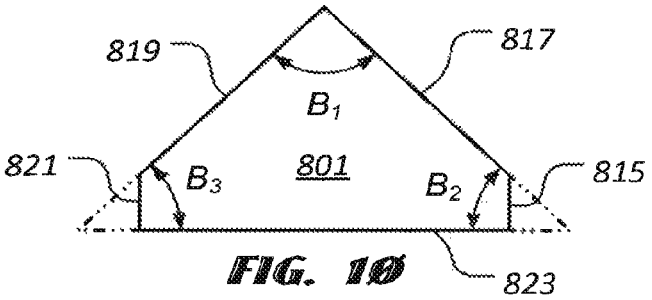
FIG. 10 is an end, elevational view of one of the prismatic element of FIG. 8.

As shown in FIG. 10, first base 801 of prismatic elements 203 and 207, as well as second base 803, is generally triangular with clipped or truncated corners in the illustrated embodiment. Edges 817 and 819 define an angle 81, edges 817 and 823 define an angle 82, and edges 819 and 823 define an angle 83. In one embodiment, first base 801, as well as second base 803, is an isosceles triangle, such that angle 82 is substantially equal to angle 83. In one particular embodiment, angles 82 and 83 are about 45 degrees and angle 81 is about 90 degrees. As discussed herein, prismatic elements 705 and 709 are truncated portions of prismatic elements 703 and 707. Accordingly, prismatic elements 705 and 709 have configurations that correspond to the portions of prismatic elements 703 and 707 that are common to prismatic elements 705 and 709.

Figure 11:
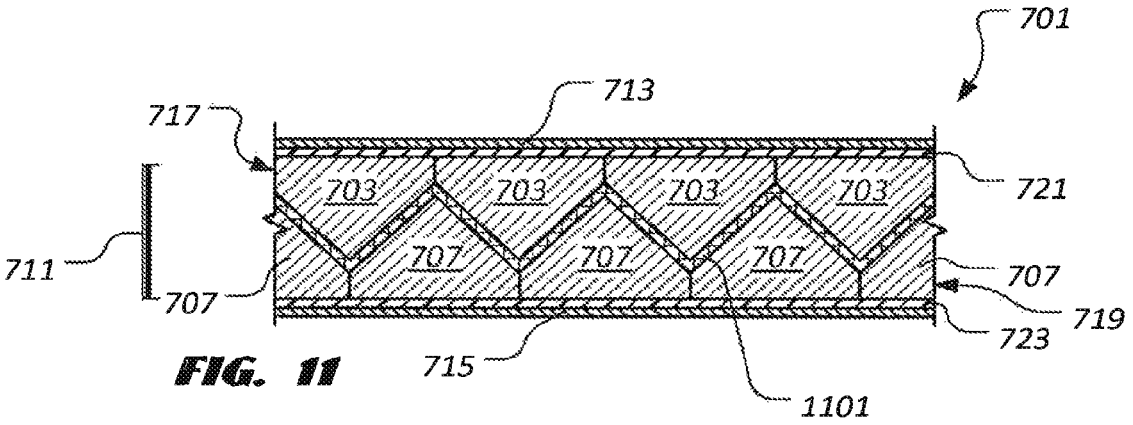
FIG. 11 is a cross-sectional view of a portion of the armor embodiment of FIG. 7, taken along the line 11-11 in FIG. 7.

FIG. 11 depicts a cross-sectional view of the embodiment of armor 701 shown in FIG. 7, taken along the line 11-11 in FIG. 7. As discussed herein in relation to FIG. 7, core 711 is disposed between strike face sheet 713 and rear face sheet 715. In some but not all embodiments, viscoelastic layer 721 is disposed between core 711 and strike face sheet 713 and viscoelastic layer 723 is disposed between core 711 and rear face sheet 715. Core 711 comprises first layer 717 of prismatic elements 703 and 705 and second layer 719 of prismatic elements 707 and 709. As noted herein, strain isolation layer 1101 is disposed between first layer 717 and second layer 719. Strain isolation layer 1101 impedes shock waves and the like from being propagated from first layer 717 to second layer 719. Rather than transmitting such shock waves to second layer 719, strain isolation layer 1101 elastically, and in some situations viscoelastically, deforms to absorb shock wave energy that would otherwise propagate into second layer 719. Strain isolation layer 1101 may comprise, for example, any of the materials deemed suitable for strain isolation layer 601, shown in FIG. 6.

In certain embodiments, viscoelastic layer 721, viscoelastic layer 723, and/or strain isolation layer 1101 adhesively bond adjacent members. For example, viscoelastic layer 721 may adhesively bond strike face sheet 713 to layer 717 of prismatic elements 703 and 705. Viscoelastic layer 723 may, in some embodiments, adhesively bond rear face sheet 715 to layer 719 of prismatic elements 707 and 709. Strain isolation layer 1101, in some embodiments, may adhesively bond layer 717 of prismatic elements 703 and 705 to layer 719 of prismatic elements 707 and 709. In other embodiments, however, adjacent members may be adhesively bonded to one another via a separate bonding agent. In other embodiments, adjacent members may not be adhesively bonded to one another.

As noted herein, the prismatic elements making up a layer of prismatic elements are configured in a tessellated fashion. For example, prismatic elements 703 and 705 (shown in FIG. 7) of layer 717 (shown in FIG. 7) and prismatic elements 707 and 709 (shown in FIG. 7) of layer 719 (shown in FIG. 7) are configured in a tessellated fashion.

Figure 12:
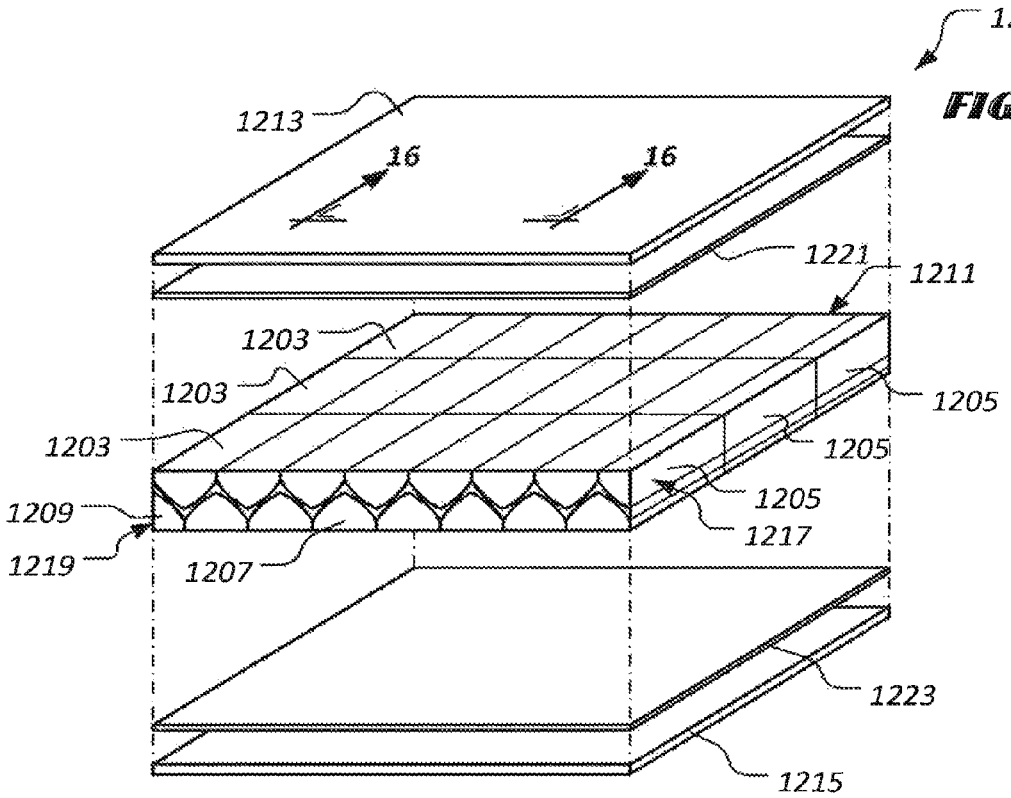
FIG. 12 is a partially exploded, perspective view of a third illustrative embodiment of an armor.

FIG. 12 depicts an exploded view of a third illustrative embodiment of an armor 1201. The configuration of armor 1201 corresponds to the configuration of armor 101 (shown in FIG. 1) except for the configurations of prismatic elements 1203, 1205, 1207, and 1209, of which a core 1211 of armor 1201 is comprised. In the illustrated embodiment, armor 1201 comprises core 1211 disposed between a strike face sheet 1213 and a rear face sheet 1215. As in the first embodiment, strike face sheet 1213 comprises a material that will, to some degree, substantially impede the progress of a ballistic projectile. The materials discussed herein as being suitable or preferred for strike face sheet 105 (shown in at least FIGS. 1 and 2) are also suitable or preferred for strike face sheet 1213. Preferably, rear face sheet 1215 comprises a material that significantly reduces the velocity of spall (e.g., projectile fragments, fragments of armor 1201, or the like) exiting armor 1201. More preferably, rear face sheet 1215 comprises a material that will substantially prevent such spall from exiting armor 1201. The materials discussed herein as being preferred for rear face sheet 201 (shown in at least FIG. 2) are also preferred for rear face sheet 1215. It should be noted, however, that the particular compositions of strike face sheet 1213 and rear face sheet 1215 are implementation specific. Accordingly, other materials for strike face sheets, such as strike face sheet 1213, and for rear face sheets, such as rear face sheet 1215, are contemplated by the present invention.

Core 1211 comprises a plurality of layers 1217 and 1219 of tessellated, prismatic elements 1203, 1205, 1207, and 1209. Prismatic elements 1203, 1205, 1207, and 1209 may comprise various different materials, even with in the same armor 1201. The materials disclosed herein as being suitable for prismatic elements 203, 205, 207, and 209 (shown in at least FIG. 2) are also suitable for prismatic elements 1203, 1205, 1207, and 1209. Prismatic elements 1203 and 1205 make up layer 1217, while prismatic elements 1207 and 1209 make up layer 1219. Layers 1217 and 1219 are separated by a strain isolation layer 1601, shown in FIG. 16 and described in greater detail herein. In certain embodiments, armor 1201 comprises a first viscoelastic layer 1221, disposed between core 1211 and strike face sheet 1213, and/or a second viscoelastic layer 1223, disposed between core 1211 and rear face sheet 1215. In other embodiments, viscoelastic layers 1221 and 1223 are omitted from armor 1201. The materials discussed herein as being suitable or preferred for viscoelastic layers 211 and 213, shown in at least FIG. 2, are also suitable or preferred for viscoelastic layers 1221 and 1223.

Figure 13:
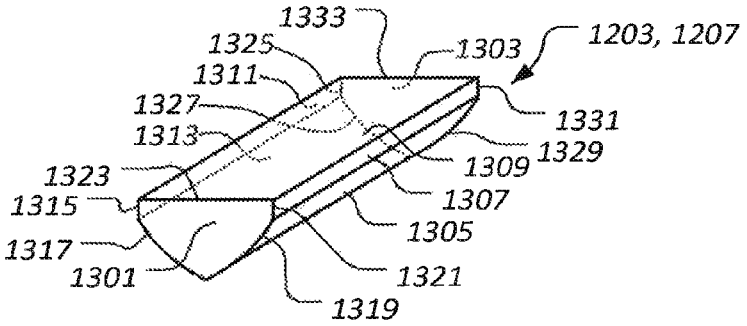
FIGS. 13 and 14 are perspective views of illustrative embodiments of prismatic elements of the armor embodiment of FIG. 12.

FIG. 13 depicts an illustrative embodiment of prismatic elements 1203 and 1207. In the embodiment of FIG. 13, prismatic elements 1203 and 1207 include a first base 1301, a second base 1303, and a plurality of faces 1305, 1307, 1309, 1311, and 1313 extending therebetween. First base 1301 and second base 1303, as well as other such corresponding bases, are closed, planar figures bounded by substantially straight and/or curved edges. In the embodiment of FIG. 13, first base 1301 is a closed, planar figure bounded by substantially straight edges 1315, 1321, and 1323 and bounded by curved edges 1317 and 1319. Second base 1303 is a closed, planar figure bounded by substantially straight edges 1325, 1331, and 1333 and bounded by curved edges 1327 and 1329. It should be noted, however, that prismatic element 1203 may have a configuration that omit edges 1315 and 1321, such that edges 1317 and 1319 extend to edge 1323. Prismatic element 1207 may also have such a configuration.

Figure 14:
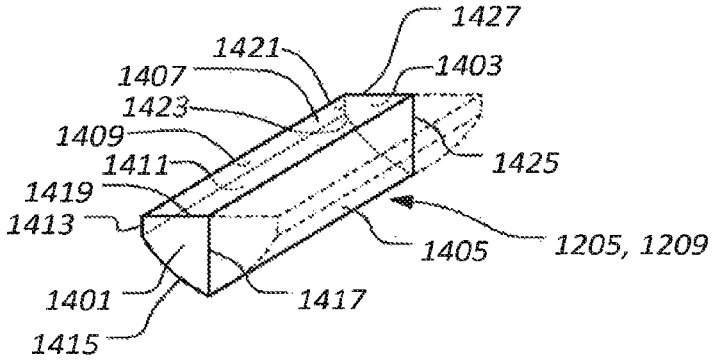

FIG. 14 depicts an illustrative embodiment of prismatic elements 1205 and 1209. Prismatic elements 1205 and 1209 are truncated portions of prismatic elements 1203 and 1207. In the embodiment of FIG. 14, prismatic elements 1205 and 1209 take on the form of substantially half of prismatic elements 1203 and 1207, although other configurations are contemplated by the present invention. It should be noted that the omitted portion of prismatic element 1203 or 1207 is shown in phantom in FIG. 14. In the illustrated embodiment, prismatic elements 1205 and 1209 include a first base 1401, a second base 1403, and a plurality of faces 1405, 1407, 1409, and 1411 extending therebetween. First base 1401 and second base 1403 are closed, planar figures bounded by substantially straight and/or curved edges. In the embodiment of FIG. 14, first base 1401 is a closed, planar figure bounded by substantially straight edges 1413, 1417, and 1419 and bounded by a curved edge 1415. Second base 1403 is a closed, planar figure bounded by substantially straight edges 1421, 1425, and 1427 and bounded by a curved edge 1423.

Figure 15:
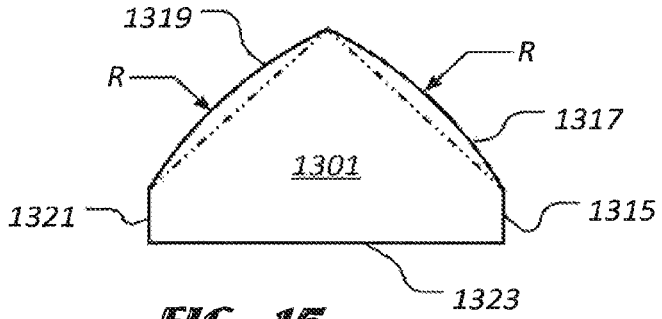
FIG. 15 is an end, elevational view of the prismatic element of FIG. 13.

As shown in FIG. 15, first base 1301 of prismatic elements 1203 and 1207, as well as second base 1303 thereof, corresponds to first base 801 and second base 803 of prismatic elements 703 and 707 (shown in FIG. 8) except that edges 1317 and 1319 are curved rather than being substantially straight and faces 1305 and 1313 (shown in FIG. 13) are not planar. Note that a corresponding outline for first base 801 is shown in phantom in FIG. 15. Edges 1317 and 1319, and thus faces 1305 and 1313, are convex in nature, exhibiting a radius R. As discussed herein, prismatic elements 1205 and 1209 are truncated portions of prismatic elements 1203 and 1207. Accordingly, prismatic elements 1205 and 1209 have configurations that correspond to the portions of prismatic elements 1203 and 1207 that are common to prismatic elements 1205 and 1209.

Figure 16:
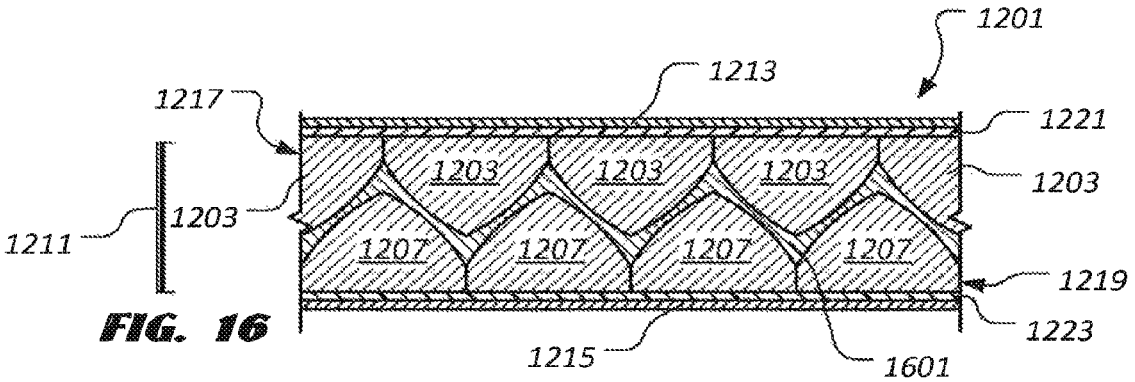
FIG. 16 is a cross-sectional view of a portion of the armor of FIG. 12, taken along the line 16-16 in FIG. 12.

FIG. 16 depicts a cross-sectional view of the embodiment of armor 1201 shown in FIG. 12, taken along the line 16-16 in FIG. 12. As discussed herein in relation to FIG. 12, core 1211 is disposed between strike face sheet 1213 and rear face sheet 1215. In some but not all embodiments, viscoelastic layer 1221 is disposed between core 1211 and strike face sheet 1213 and viscoelastic layer 1223 is disposed between core 1211 and rear face sheet 1215. Core 1211 comprises first layer 1217 of prismatic elements 1203 and 1205 and second layer 1219 of prismatic elements 1207 and 1209. As noted herein, strain isolation layer 1601 is disposed between first layer 1217 and second layer 1219. Strain isolation layer 1601 impedes shock waves and the like from being propagated from first layer 1217 to second layer 1219. Rather than transmitting such shock waves to second layer 1219, strain isolation layer 1601 elastically, and in some situations viscoelastically, deforms to absorb shock wave energy that would otherwise propagate into second layer 1219. Strain isolation layer 1601 may comprise, for example, any of the materials deemed suitable for strain isolation layer 601, shown in FIG. 6.

In certain embodiments, viscoelastic layer 1221, viscoelastic layer 1223, and/or strain isolation layer 1601 adhesively bond adjacent members. For example, viscoelastic layer 1221 may adhesively bond strike face sheet 1213 to layer 1217 of prismatic elements 1203 and 1205. Viscoelastic layer 1223 may, in some embodiments, adhesively bond rear face sheet 1215 to layer 1219 of prismatic elements 1207 and 1209. Strain isolation layer 1601, in some embodiments, may adhesively bond layer 1217 of prismatic elements 1203 and 1205 to layer 1219 of prismatic elements 1207 and 1209. In other embodiments, however, adjacent members may be adhesively bonded to one another via a separate bonding agent. In other embodiments, adjacent members may not be adhesively bonded to one another.

As noted herein, the prismatic elements making up a layer of prismatic elements are configured in a tessellated fashion. For example, prismatic elements 1203 and 1205 (shown in FIG. 12) of layer 1217 (shown in FIG. 12) and prismatic elements 1207 and 1209 (shown in FIG. 12) of layer 1219 (shown in FIG. 12) are configured in a tessellated fashion.

Figure 17A:
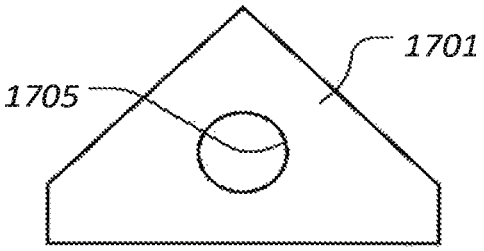
FIG. 17A is an end, elevational view of an alternative, illustrative embodiment of a prismatic element.
Figure 17B:
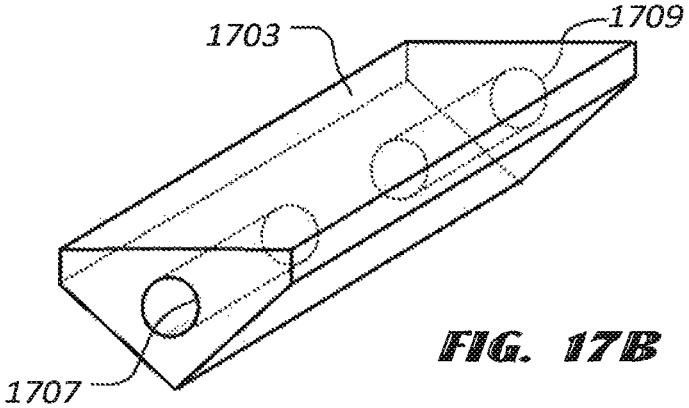
FIGS. 17B and 17C are alternative views of an illustrative embodiment of a prismatic element.
Figure 17C:
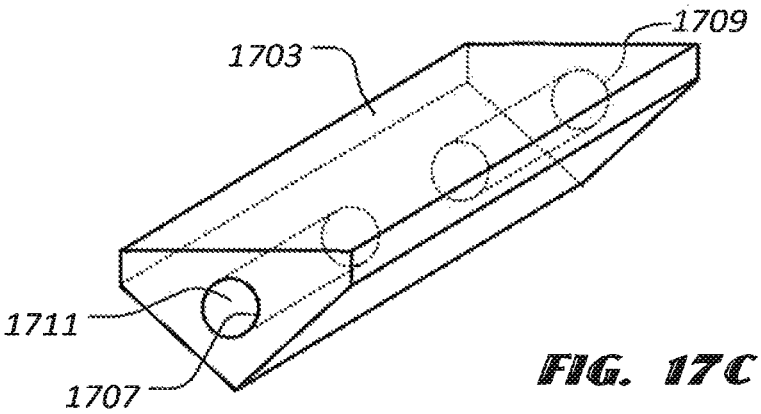

As shown in FIGS. 17A and 17B, prismatic elements, such as prismatic elements 1701 and 1703, may define a longitudinal passageway or cavity, such as passageway 1705 in FIG. 17A and cavities 1707 and 1709 in FIG. 178, disposed, for example, at a centroid of the prismatic element. Such passageways and cavities are often desirable to decrease the weight of the prismatic elements and may extend into but not through the prismatic element, as shown in FIG. 178, or entirely through the prismatic element, as shown in FIG. 17A. It should also be noted that an explosive material, such as the materials described herein concerning FIG. 28, can be disposed in any of such passageways or cavities, such as passageway 1705 and cavities 1707, and 1709. FIG. 17C depicts one such implementation, in which an explosive material 1711 is disposed in cavity 1707. Such configurations are particularly useful in protecting against shaped charge jets and explosively-formed projectiles, as explosive material 1711 detonates via a shock wave generated by the shaped charge jet or explosively-formed projectile. The detonation provides sufficient mass and energy to disrupt the jet or projectile, thus impeding penetration.

Figure 18:
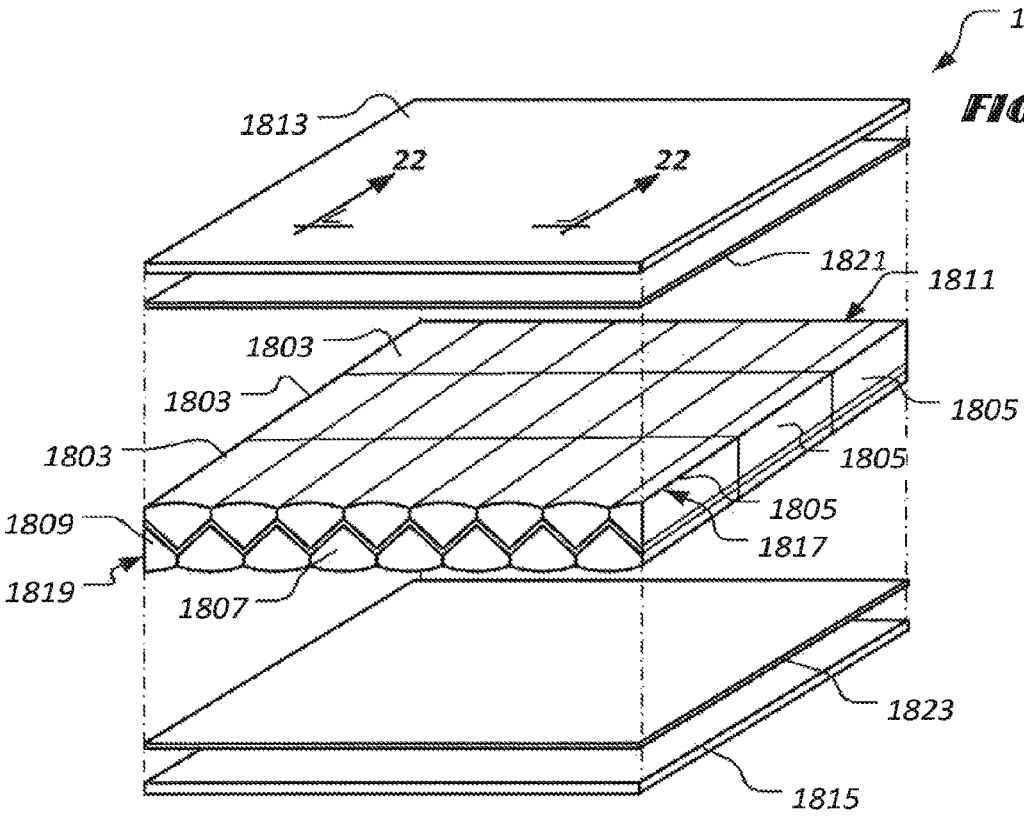
FIG. 18 is a partially exploded, perspective view of a fourth illustrative embodiment of an armor.

FIG. 18 depicts an exploded view of a fourth illustrated embodiment of an armor 1801. The configuration of armor 1801 corresponds to the configuration of armor 101 (shown in FIG. 1) except for the configurations of prismatic elements 1803, 1805, 1807, and 1809, of which a core 1811 of armor 1801 is comprised. In the illustrated embodiment, armor 1801 comprises core 1811 disposed between a strike face sheet 1813 and a rear face sheet 1815. As in the first embodiment, strike face sheet 1813 comprises a material that will, to some degree, substantially impede the progress of a ballistic projectile. The materials discussed herein as being suitable or preferred for strike face sheet 105 (shown in at least FIGS. 1 and 2) are also suitable or preferred for strike face sheet 1813. Preferably, rear face sheet 1815 comprises a material that significantly reduces the velocity of spall (e.g., projectile fragments, fragments of armor 1801, or the like) exiting armor 1801. More preferably, rear face sheet 1815 comprises a material that will substantially prevent such spall from exiting armor 1801. The materials discussed herein as being preferred for rear face sheet 201 (shown in at least FIG. 2) are also preferred for rear face sheet 1815. It should be noted, however, that the particular compositions of strike face sheet 1813 and rear face sheet 1815 are implementation specific. Accordingly, other materials for strike face sheets, such as strike face sheet 1813, and for rear face sheets, such as rear face sheet 1815, are contemplated by the present invention.

Core 1811 comprises a plurality of layers 1817 and 1819 of tessellated, prismatic elements 1803, 1805, 1807, and 1809. Prismatic elements 1803, 1805, 1807, and 1809 may comprise various different materials, even with in the same armor 1801. The materials disclosed herein as being suitable for prismatic elements 203, 205, 207, and 209 (shown in at least FIG. 2) are also suitable for prismatic elements 1803, 1805, 1807, and 1809. Prismatic elements 1803 and 1805 make up layer 1817, while prismatic elements 1807 and 1809 make up layer 1819. Layers 1817 and 1819 are separated by a strain isolation layer 2201, shown in FIG. 22 and described in greater detail herein. In certain embodiments, armor 1801 comprises a first viscoelastic layer 1821, disposed between core 1811 and strike face sheet 1813, and/or a second viscoelastic layer 1823, disposed between core 1811 and rear face sheet 1815. In other embodiments, viscoelastic layers 1821 and 1823 are omitted from armor 1801. The materials discussed herein as being suitable or preferred for viscoelastic layers 211 and 213, shown in at least FIG. 2, are also suitable or preferred for viscoelastic layers 1821 and 1823.

Figure 19:
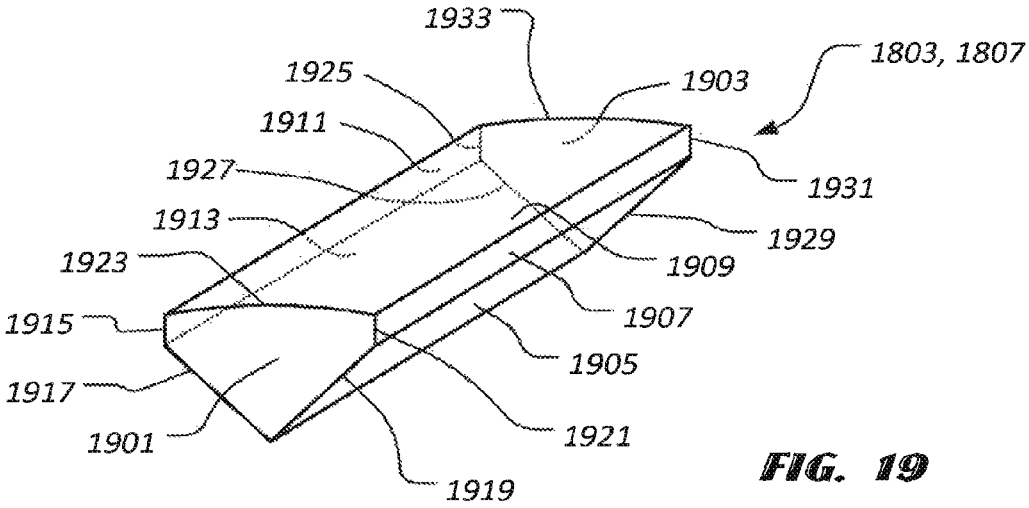
FIGS. 19 and 20 are perspective views of illustrative embodiments of prismatic elements of the armor of FIG. 18.

FIG. 19 depicts an illustrative embodiment of prismatic elements 1803 and 1807. In the embodiment of FIG. 19, prismatic elements 1803 and 1807 include a first base 1901, a second base 1903, and a plurality of faces 1905, 1907, 1909, 1911, and 1913 extending therebetween. First base 1901 and second base 1903, as well as other such corresponding bases, are closed, planar figures bounded by substantially straight and/or curved edges. In the embodiment of FIG. 19, first base 1901 is a closed, planar figure bounded by substantially straight edges 1915, 1917, 1919, and 1921 and bounded by a curved edge 1923. Second base 1903 is a closed, planar figure bounded by substantially straight edges 1925, 1927, 1929, and 1931 and bounded by a curved edge 1933. It should be noted, however, that prismatic element 1803 may have a configuration that omit edges 1915 and 1921, such that edges 1917 and 1919 extend to edge 1923. Prismatic element 1807 may also have such a configuration.

Figure 20:
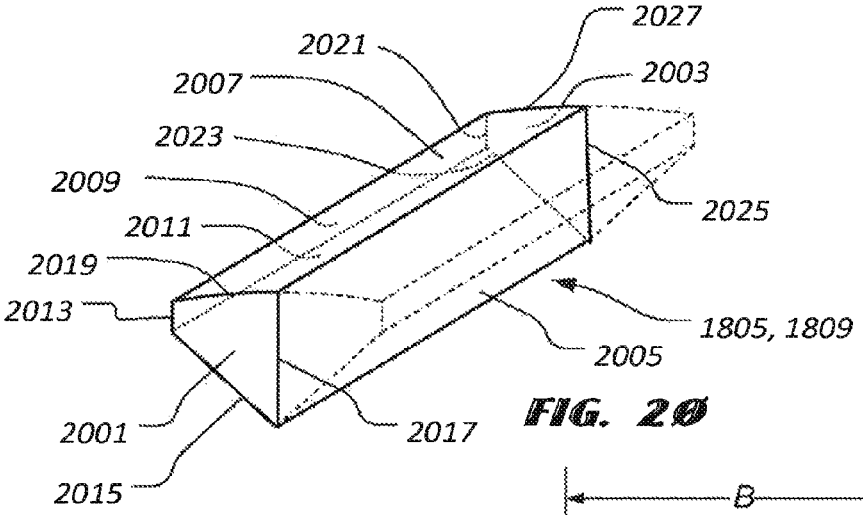

FIG. 20 depicts an illustrative embodiment of prismatic elements 1805 and 1809. Prismatic elements 1805 and 1809 are truncated portions of prismatic elements 1803 and 1807. In the embodiment of FIG. 20, prismatic elements 1805 and 1809 take on the form of substantially half of prismatic elements 1803 and 1807, although other configurations are contemplated by the present invention. It should be noted that the omitted portion of prismatic element 1803 or 1807 is shown in phantom in FIG. 20. In the illustrated embodiment, prismatic elements 1805 and 1809 include a first base 2001, a second base 2003, and a plurality of faces 2005, 2007, 2009, and 2011 extending therebetween. First base 2001 and second base 2003 are closed, planar figures bounded by substantially straight and/or curved edges. In the embodiment of FIG. 20, first base 2001 is a closed, planar figure bounded by substantially straight edges 2013, 2015, and 2017 and bounded by a curved edge 2019. Second base 2003 is a closed, planar figure bounded by substantially straight edges 2021, 2023, and 2025 and hounded by a curved edge 2027.

Figure 21:
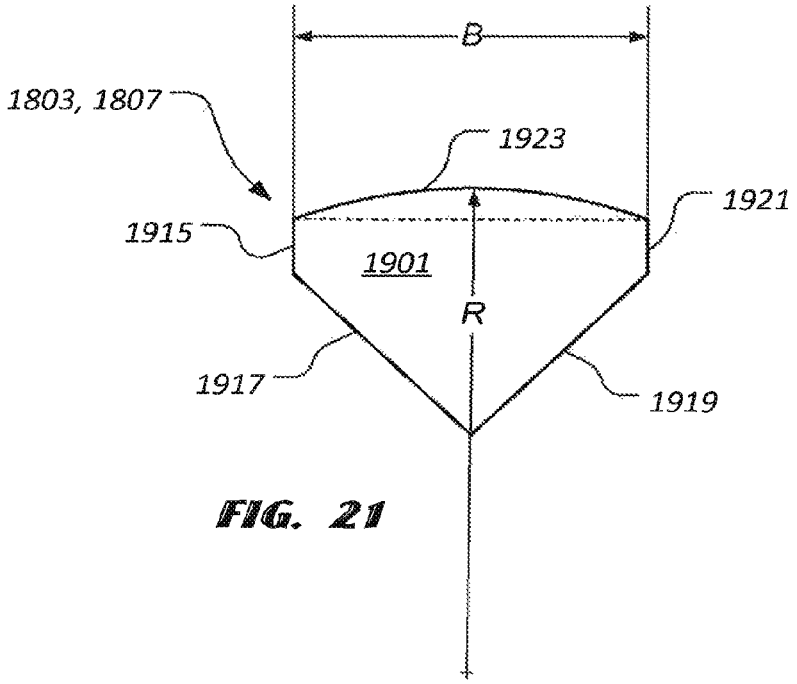
FIG. 21 is an end, elevational view of the prismatic element of FIG. 19.

As shown in FIG. 21, first base 1901 of prismatic elements 1803 and 1807, as well as second base 1903 thereof, corresponds to first base 801 and second base 803 of prismatic elements 703 and 707 (shown in FIG. 8) except that edge 1923 is curved rather than being substantially straight and face 1909 (shown in FIG. 19) is not planar. Note that a corresponding outline for first base 801 is shown in phantom in FIG. 21. Edge 1923, and thus face 1909, are convex in nature, exhibiting a radius R. As discussed herein, prismatic elements 1805 and 1809 are truncated portions of prismatic elements 1803 and 1807. Accordingly, prismatic elements 1805 and 1809 have configurations that correspond to the portions of prismatic elements 1803 and 1807 that are common to prismatic elements 1805 and 1809.

Figure 22:
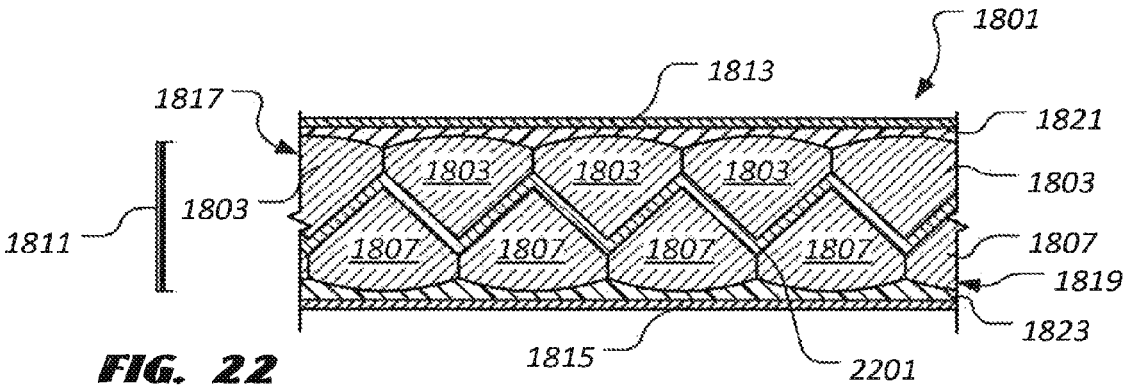
FIG. 22 is a cross-sectional view of a portion of the armor of FIG. 18, taken along the line 22-22 in FIG. 18.

FIG. 22 depicts a cross-sectional view of the embodiment of armor 1801 shown in FIG. 18, taken along the line 22-16 in FIG. 18. As discussed herein in relation to FIG. 18, core 1811 is disposed between strike face sheet 1813 and rear face sheet 1815. In some but not all embodiments, viscoelastic layer 1821 is disposed between core 1811 and strike face sheet 1813 and viscoelastic layer 1823 is disposed between core 1811 and rear face sheet 1815. Core 1811 comprises first layer 1817 of prismatic elements 1803 and 1805 and second layer 1819 of prismatic elements 1807 and 1809. As noted herein, strain isolation layer 2201 is disposed between first layer 1817 and second layer 1819. Strain isolation layer 2201 impedes shock waves and the like from being propagated from first layer 1817 to second layer 1819. Rather than transmitting such shock waves to second layer 1819, strain isolation layer 2201 elastically, and in some situations viscoelastically, deforms to absorb shock wave energy that would otherwise propagate into second layer 1219. Strain isolation layer 2201 may comprise, for example, any of the materials deemed suitable for strain isolation layer 601, shown in FIG. 6.

In certain embodiments, viscoelastic layer 1821, viscoelastic layer 1823, and/or strain isolation layer 2201 adhesively bond adjacent members. For example, viscoelastic layer 1821 may adhesively bond strike face sheet 1813 to layer 1817 of prismatic elements 1803 and 1805. Viscoelastic layer 1823 may, in some embodiments, adhesively bond rear face sheet 1815 to layer 1819 of prismatic elements 1807 and 1809. Strain isolation layer 2201, in some embodiments, may adhesively bond layer 1817 of prismatic elements 1803 and 1805 to layer 1819 of prismatic elements 1807 and 1809. In other embodiments, however, adjacent members may be adhesively bonded to one another via a separate bonding agent. In other embodiments, adjacent members may not be adhesively bonded to one another.

As noted herein, the prismatic elements making up a layer of prismatic elements are configured in a tessellated fashion. For example, prismatic elements 1803 and 1805 (shown in FIG. 18) of layer 1817 (shown in FIG. 18) and prismatic elements 1807 and 1809 (shown in FIG. 18) of layer 1819 (shown in FIG. 18) are configured in a tessellated fashion.

Figure 23:
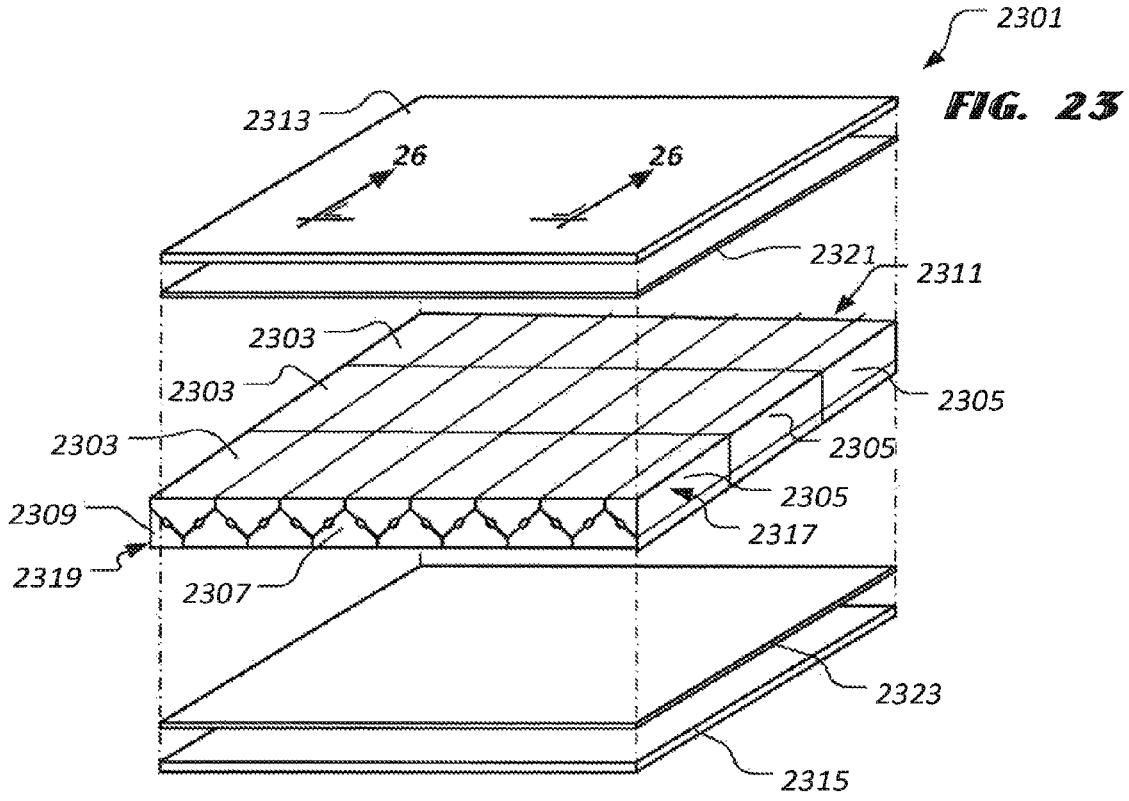
FIG. 23 is a partially exploded, perspective view of a fifth illustrative embodiment of an armor.

FIG. 23 depicts an exploded view of a fifth illustrated embodiment of an armor 2301. The configuration of armor 2301 corresponds to the configuration of armor 101 (shown in FIG. 1) except for the configurations of prismatic elements 2303, 2305, 2307, and 2309, of which a core 2311 of armor 2301 is comprised. In the illustrated embodiment, armor 2301 comprises core 2311 disposed between a strike face sheet 2313 and a rear face sheet 2315. As in the first embodiment, strike face sheet 2313 comprises a material that will, to some degree, substantially impede the progress of a ballistic projectile. The materials discussed herein as being suitable or preferred for strike face sheet 105 (shown in at least FIGS. 1 and 2) are also suitable or preferred for strike face sheet 2313. Preferably, rear face sheet 2315 comprises a material that significantly reduces the velocity of spall (e.g., projectile fragments, fragments of armor 2301, or the like) exiting armor 2301. More preferably, rear face sheet 2315 comprises a material that will substantially prevent such spall from exiting armor 2301. The materials discussed herein as being preferred for rear face sheet 201 (shown in at least FIG. 2) are also preferred for rear face sheet 2315. It should be noted, however, that the particular compositions of strike face sheet 2313 and rear face sheet 2315 are implementation specific. Accordingly, other materials for strike face sheets, such as strike face sheet 2313, and for rear face sheets, such as rear face sheet 2315, are contemplated by the present invention.

Core 2311 comprises a plurality of layers 2317 and 2319 of tessellated, prismatic elements 2303, 2305, 2307, and 2309. Prismatic elements 2303, 2305, 2307, and 2309 may comprise various different materials, even with in the same armor 2301. The materials disclosed herein as being suitable for prismatic elements 203, 205, 207, and 209 (shown in at least FIG. 2) are also suitable for prismatic elements 2303, 2305, 2307, and 2309. Prismatic elements 2303 and 2305 make up layer 2317, while prismatic elements 2307 and 2309 make up layer 2319. Layers 2317 and 2319 are separated by a strain isolation layer, such as strain isolation layers 601, 1101, 1601, and 2201, shown in FIGS. 6, 11, 16, and 22, respectively. In certain embodiments, armor 2301 comprises a first viscoelastic layer 2321, disposed between core 2311 and strike face sheet 2313, and/or a second viscoelastic layer 2323, disposed between core 2311 and rear face sheet 2315. In other embodiments, viscoelastic layers 2321 and 2323 are omitted from armor 2301. The materials discussed herein as being suitable or preferred for viscoelastic layers 211 and 213, shown in at least FIG. 2, are also suitable or preferred for viscoelastic layers 2321 and 2323.

Figure 24:
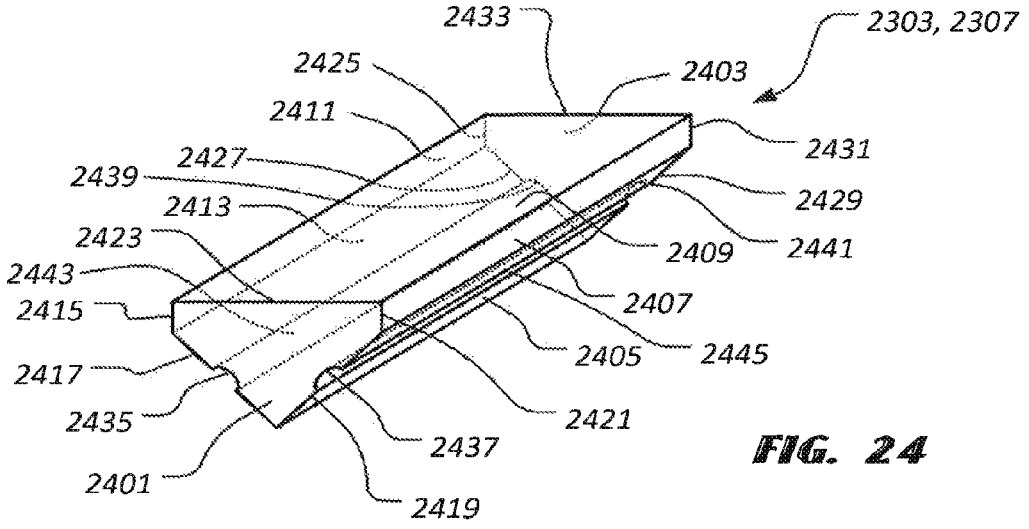
FIGS. 24 and 25 are perspective views of illustrative embodiments of prismatic elements of the armor of FIG. 23.

FIG. 24 depicts an illustrative embodiment of prismatic elements 2303 and 2307. In the embodiment of FIG. 24, prismatic elements 2303 and 2307 include a first base 2401, a second base 2403, and a plurality of faces 2405, 2407, 2409, 2411, and 2413 extending therebetween. First base 2401 and second base 2403, as well as other such corresponding bases, are closed, planar figures bounded by Substantially straight and/or curved edges. In the embodiment of FIG. 24, first base 2401 is a closed, planar figure bounded by substantially straight edges 2415, 2421, and 2423. First base is further bounded by substantially straight edges 2417 and 2419 that include recesses or cut-outs 2435 and 2437, respectively. Second base 2403 is a closed, planar figure bounded by substantially straight edges 2425, 2431, and 2433. Second base 2403 is further bounded by substantially straight edges 2427 and 2429 that include recesses or cut-outs 2439 and 2441, respectively. A channel 2443 is defined by face 2413 and extends between recesses 2435 and 2439. Similarly, a channel 2445 is defined by face 2405 and extends between recesses 2437 and 2441. It should be noted that channels 2443 and 2445 may be incorporated into other embodiments of the present armor. It should also be noted that prismatic elements 2303 may have a configuration that omit edges 2415 and 2421, such that edges 2417 and 2419 extend to edge 2423 and edges 2425 and 2429 extend to edge 2433. Prismatic element 2307 may also have such a configuration.

Figure 25:
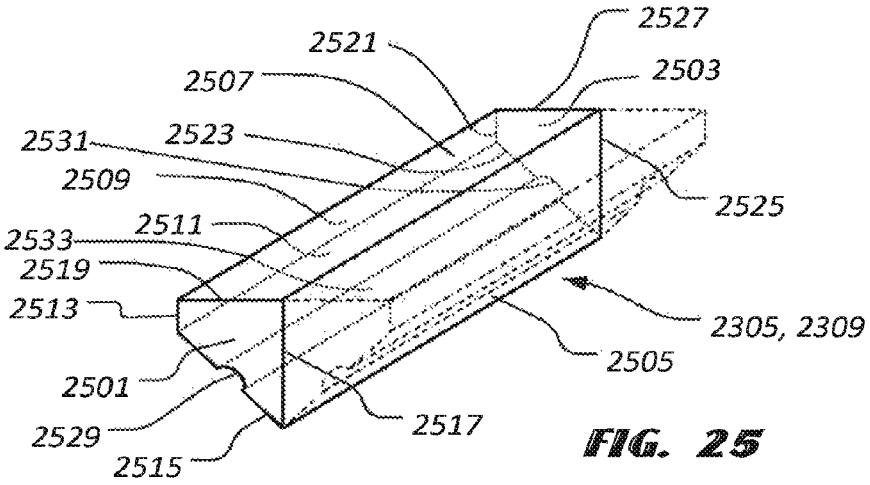

FIG. 25 depicts an illustrative embodiment of prismatic elements 2305 and 2309. Prismatic elements 2305 and 2309 are truncated portions of prismatic elements 2303 and 2307. In the embodiment of FIG. 25, prismatic elements 2305 and 2309 take on the form of substantially half of prismatic elements 2303 and 2307, although other configurations are contemplated by the present invention. It should be noted that the omitted portion of prismatic element 2303 or 2307 is shown in phantom in FIG. 25. In the illustrated embodiment, prismatic elements 2305 and 2309 include a first base 2501, a second base 2503, and a plurality of faces 2505, 2507, 2509, and 2511 extending therebetween. First base 2501 and second base 2503 are closed, planar figures bounded by substantially straight and/or curved edges. In the embodiment of FIG. 25, first base 2501 is a closed, planar figure bounded by substantially straight edges 2513, 2517, and 2519. First base 2501 is further bounded by a substantially straight edge 2515 that includes a recess or cut-out 2529. Second base 2503 is a closed, planar figure bounded by substantially straight edges 2521, 2525, and 2527. Second base 2503 is further bounded by substantially straight edge 2521 that includes a recess or cut-out 2531. A channel 2533 is defined by face 2511 and extends between recesses 2529 and 2531. It should be noted that channel 2533 may be incorporated into other embodiments of the present armor. It should also be noted that prismatic elements 2305 may have a configuration that omit edges 2513 and 2521, such that edge 2515 extends to edge 2519 and edge 2523 extends to edge 3527. Prismatic element 2307 may also have such a configuration.

Figure 26:
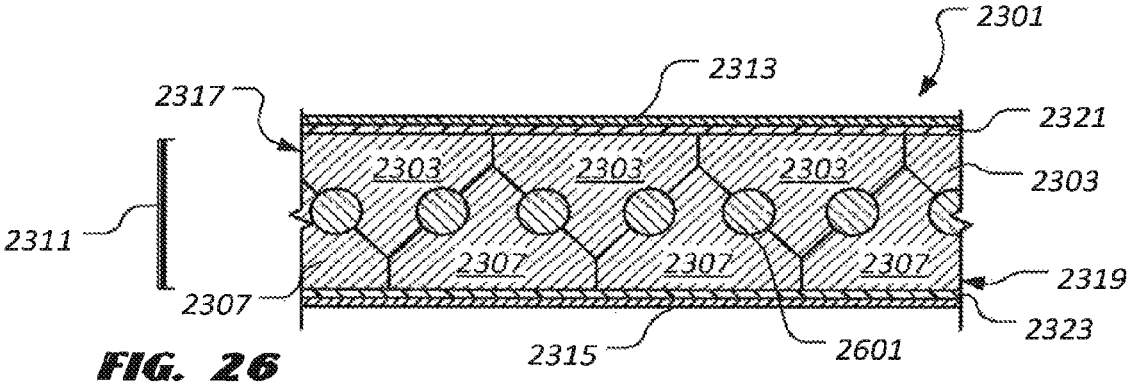
FIG. 26 is a cross-sectional view of a portion of the armor of FIG. 23, taken along the line 26-26 in FIG. 23.

FIG. 26 depicts a cross-sectional view of the embodiment of armor 2301 shown in FIG. 23, taken along the line 26-26 in FIG. 23. As discussed herein in relation to FIG. 23, core 2311 is disposed between strike face sheet 2313 and rear face sheet 2315. In some but not all embodiments, viscoelastic layer 2321 is disposed between core 2311 and strike face sheet 2313 and viscoelastic layer 2323 is disposed between core 2311 and rear face sheet 2315. Core 2311 comprises first layer 2317 of prismatic elements 2303 and 2305 and second layer 2319 of prismatic elements 2307 and 2309. It should be noted that a strain isolation layer, such as strain isolation layers 601, 1101, 1601, 2201, or the like may be disposed between first layer 2317 and second layer 2319. Such a strain isolation layer impedes shock waves and the like from being propagated from first layer 2317 to second layer 2319. Rather than transmitting such shock waves to second layer 2319, the strain isolation layer elastically, and in some situations viscoelastically, deforms to absorb shock wave energy that would otherwise propagate into second layer 2319. Such a strain isolation layer may comprise, for example, any of the materials deemed suitable for strain isolation layer 601, shown in FIG. 6.

In certain embodiments, viscoelastic layer 2321, viscoelastic layer 2323, and/or the strain isolation layer, if present, adhesively bond adjacent members. For example, viscoelastic layer 2321 may adhesively bond strike face sheet 2313 to layer 2317 of prismatic elements 2303 and 2305. Viscoelastic layer 2323 may, in some embodiments, adhesively bond rear face sheet 2315 to layer 2319 of prismatic elements 2307 and 2309. A strain isolation layer, if present in some embodiments, may adhesively bond layer 2317 of prismatic elements 2303 and 2305 to layer 2319 of prismatic elements 2307 and 2309. In other embodiments, however, adjacent members may be adhesively bonded to one another via a separate bonding agent. In other embodiments, adjacent members may not be adhesively bonded to one another.

As noted herein, the prismatic elements making up a layer of prismatic elements are configured in a tessellated fashion. For example, prismatic elements 2303 and 2305 (shown in FIG. 23) of layer 2317 (shown in FIG. 23) and prismatic elements 2307 and 2309 (shown in FIG. 23) of layer 2319 (shown in FIG. 23) are configured in a tessellated fashion.

Still referring to FIG. 26, channels 2443 and 2445 of adjacent prismatic elements 2303 and 2307 form a cavity, which may remain substantially devoid of material or in which an explosive material 2601 (only one labeled in FIG. 26 for clarity) may be disposed. Channels 2443 and 2445 may extend partway along faces 2413 and 2405, respectively, or may extend the entire lengths of faces 2413 and 2405. The particular explosive material 2601 employed is implementation-specific and the present invention contemplates many various explosive materials for explosive material 2601. Examples of materials for explosive material 2601 include, but are not limited to, any high explosive, any low-sensitivity explosive, cyclotrimethylenetrinitramine (ROX), plastic-bonded explosive (PBX), cyclotetramethylenetetranitramine (HMX), and the like. Configurations employing explosive materials, such as explosive 2601, are particularly useful in protecting against shaped charge jets and explosively-formed projectiles, as explosive material 2601 detonates via a shock wave generated by the shaped charge jet or explosively-formed projectile. The detonation provides sufficient mass and energy to disrupt the jet or projectile, thus impeding penetration.

It should be noted that, in some preferred embodiments, the heights of faces 815, 821, 913, 1315, 1321, 1413, 1915, 1921, 2013, 2415, 2421, 2513 or the like are about 20 percent of the overall heights, i.e., height H, of their corresponding prismatic elements.

Figure 27:
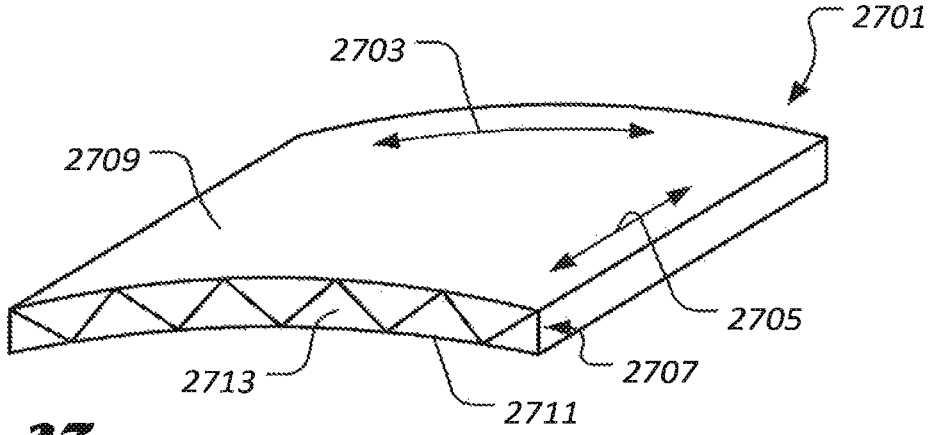
FIGS. 27-29 are perspective views illustrating curved embodiments of the present armor.
Figure 28:
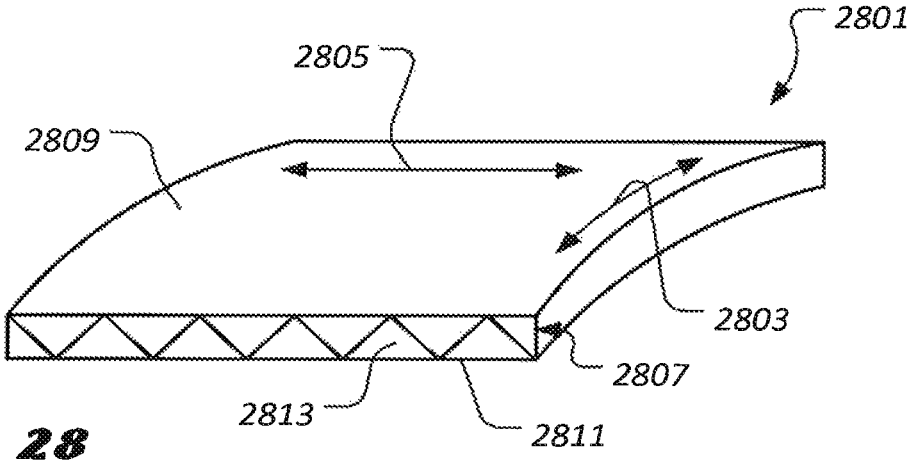
Figure 29:
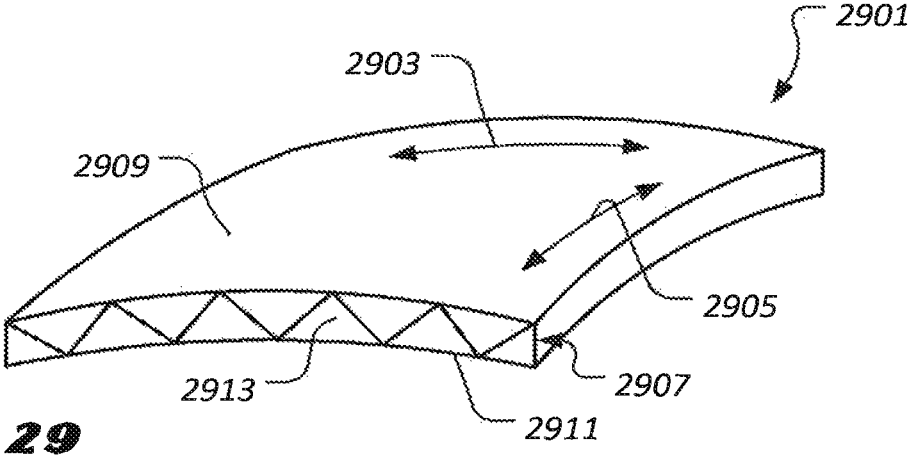

While the armor embodiments described previously herein, e.g., armor 101, 701, 1201, 1801, 2301, or the like, may be either generally planar or curved in nature, FIGS. 27-29 depict curved illustrative embodiments of the present armor. While FIGS. 27-29 depict certain configurations of armor, the present invention contemplates any embodiment disclosed herein, or the equivalent, as being either generally planar or curved. In other words, while the embodiments shown in FIGS. 27-29 embody certain characteristics, such as the particular configuration of prismatic elements, the scope of the present invention is not so limited. The present armor having any configuration, such as configuration of prismatic elements, may be generally planar or curved, as shown in FIGS. 27-29.

FIG. 27 depicts an armor 2701 that generally corresponds to armor 101 (shown in at least FIG. 1) and that is curved in directions generally corresponding to a double-headed arrow 2703. Armor 2701, however, is not curved or not appreciably curved in directions generally corresponding to a double-headed arrow 2705. Armor 2701 comprises a core 2707 disposed between a strike face sheet 2709 and a rear face sheet 2711. Core 2707 comprises a plurality of prismatic elements as in other embodiments disclosed herein, such as prismatic element 2713. The prismatic elements may have configurations corresponding to other embodiments disclosed herein but are configured such that armor 2701 is curved. In the illustrated embodiment, the prismatic elements are generally not curved in the directions corresponding to double-headed arrow 2705. Armor 2701 may include elements of other armor embodiments disclosed herein and their equivalents.

FIG. 28 depicts an armor 2801 that generally corresponds to armor 101 (shown in at least FIG. 1) and this is curved in directions generally corresponding to a double headed arrow 2803. Armor 2801, however, is not curved or not appreciably curved in directions generally corresponding to a double-headed arrow 2805. Armor 2801 comprises a core 2807 disposed between a strike face sheet 2809 and a rear face sheet 2811. Core 2807 comprises a plurality of prismatic elements as in other embodiments disclosed herein, such as prismatic element 2813. The prismatic elements may have configurations corresponding to other embodiments disclosed herein but are configured such that armor 2801 is curved. In the illustrated embodiment, the prismatic elements are generally curved in the directions corresponding to double-headed arrow 2805. Armor 2801 may include elements of other armor embodiments disclosed herein and their equivalents.

FIG. 29 depicts an armor 2901 that generally corresponds to armor 101 (shown in at least FIG. 1) and this is curved in directions generally corresponding to a double headed arrow 2903 and is curved in directions generally corresponding to a double-headed arrow 2905. Armor 2901 comprises a core 2907 disposed between a strike face sheet 2909 and a rear face sheet 2911. Core 2907 comprises a plurality of prismatic elements as in other embodiments disclosed herein, such as prismatic element 2913. The prismatic elements may have configurations corresponding to other embodiments disclosed herein but are configured such that armor 2901 is curved as described herein. In the illustrated embodiment, the prismatic elements are generally curved in the directions corresponding to double-headed arrow 2905. Armor 2901 may include elements of other armor embodiments disclosed herein and their equivalents.

It should be noted that while the embodiments of FIGS. 27-29 are shown as being curved upwardly on the drawing page, i.e., strike face sheets 2709, 2809, and 2909 are outwardly convex, the scope of the present invention is not so limited. Rather, the present armor may be curved downwardly on the drawing page, i.e., strike face sheets being outwardly concave. Moreover, the present armor may exhibit both concave and convex surface portions. In other words, strike face sheets may exhibit both concave and convex surface portions. The present invention contemplates armor having any desired, suitable geometric configuration.

Figure 30:
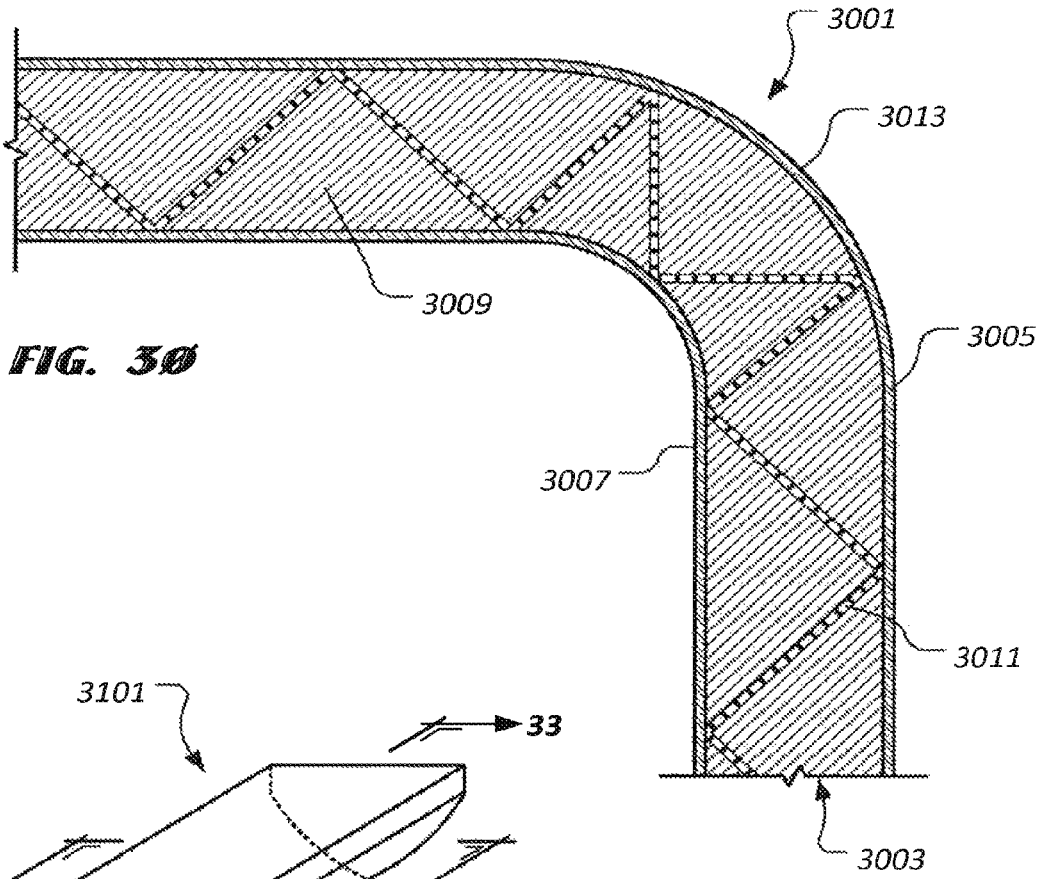
FIG. 30 is a cross-sectional view of an illustrative embodiment of an armor incorporating a corner.

The present armor may also include corners, joggles, or the like. For example, FIG. 30 depicts a cross-sectional view of a corner portion an illustrative embodiment of an armor 3001. Armor 3001 comprises a core 3003 disposed between a strike face sheet 3005 and a rear face sheet 3007. It should be noted that, in some embodiments, element 3007 is a strike face sheet and element 3005 is a rear face sheet. Core 3003 comprises a plurality of prismatic elements as in other embodiments disclosed herein, such as prismatic element 3009. The prismatic elements of core 3003 may take on the form of any embodiment shown herein and their equivalents. The prismatic elements are configured to generally conform to the geometry of strike face sheet 3005 and rear face sheet 3007. In the illustrated embodiment, core 3003 includes a strain isolation layer 3011, corresponding to other embodiments of the strain isolation layer disclosed herein. Core 3003 may also omit strain isolation layer 3011. Core 3003, strike face sheet 3005, and rear face sheet 3007 are configured to form a corner 3013 in the illustrated embodiment. While armor 3001 is depicted as including a generally 90 degree corner 3013, the present invention contemplates embodiments of armor exhibiting other angular and geometric configurations.

Figure 31:
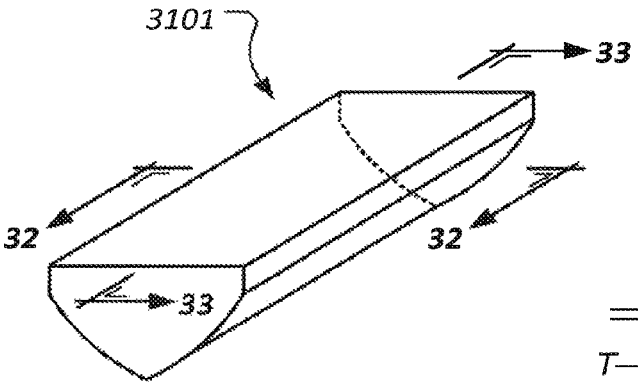
FIG. 31 is a perspective view of an illustrative embodiment of a prismatic element of the present armor.
Figure 32:
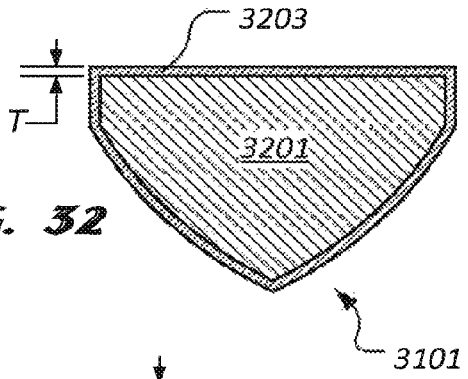
FIG. 32 is a cross-sectional view of the prismatic element of FIG. 31, taken along the line 32-32 in FIG. 31.
Figure 33:
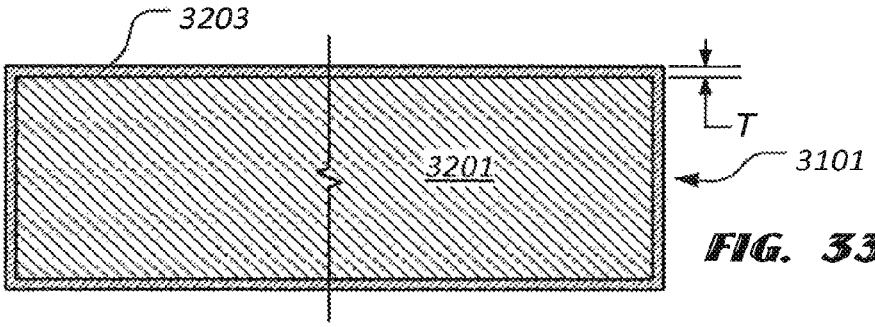
FIG. 33 is a cross-sectional view of the prismatic, element of FIG. 31, taken along the line 33-33 in FIG. 31.

Any embodiment of a prismatic element disclosed herein, and their equivalents, may include a metallic layer formed on an exterior surface of the prismatic element. The metallic layer may comprise, for example, copper, a copper alloy, tin, a tin alloy, lead, a lead alloy, gold, a gold alloy, tungsten, a tungsten alloy, silver, a silver alloy, or the like. The metallic layer may be formed by any suitable means, such as by plating, flame spraying, arc spraying, physical vapor deposition, an organometallic sol gel process, or the like. FIGS. 31-33 depict an example of one such embodiment. FIG. 31 is a perspective view of a prismatic element 3101, which may be incorporated in any embodiment of armor disclosed herein. FIG. 32 is an enlarged, cross-sectional view taken along the line 32-32 in FIG. 31, depicting an elevational, transverse, cross-sectional view of prismatic element 3101. FIG. 33 is an enlarged, cross-sectional view taken along the line 33-33 in FIG. 31, depicting an elevational, longitudinal, cross-sectional view of prismatic element 3101. Referring in particular to FIGS. 32 and 33, prismatic element 3101 comprises a prismatic substrate 3201 on which a metallic layer 3203 is disposed. It should be noted that, while prismatic substrate 3201 is shown in FIGS. 31-33 as having a particular configuration, the scope of the present invention is not so limited. Rather, prismatic substrate 3201 may, for example, exhibit a configuration corresponding to any embodiment of a prismatic element disclosed herein or its equivalent. Prismatic substrate 3201 may comprise a material corresponding to any material suitable for a prismatic element that omits metallic layer, such as those materials disclosed herein. While the present invention contemplates many various thicknesses for metallic layer 3203, metallic layer 3203 exhibits a thickness T within a range of about 0.001 inches to about 0.15 inches. Metallic layer 3203, in certain implementations, improves the shock attenuation properties of prismatic element 3101 over prismatic elements that omit metallic layer 3203.

The present invention provides significant advantages, including: (1) providing an armor capable of withstanding multiple strikes from ballistic projectiles in a small area; (2) providing an armor that has a lower areal weight than conventional armors; providing an armor that is less expensive to produce than conventional armors; providing an armor that provides enhanced protection from shaped charge jets and explosively-formed projectiles; and (5) providing an armor that exhibits some degree of transparency or translucency.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

The invention claimed is:

1. An armor comprising:

a core configured with a first layer of prismatic elements arranged in a tessellated fashion and a second layer of prismatic elements arranged in a tessellated fashion; and at least one of an explosive material, at least one computing device, at least one sensor, at least one optical fiber, at least one antenna element, and at least one electrical wire associated with at least one of a component of the armor, at least one prismatic element of the first layer of prismatic elements and at least one prismatic element of the second layer of the prismatic elements;

wherein the first layer of prismatic elements is nested into the second layer of prismatic elements;

wherein at least one prismatic elements of the first layer of prismatic elements and the second layer of prismatic elements comprise a first base, a second base, and a plurality of faces extending between the first base and the second base; and wherein at least one of the plurality of faces is non-planar to provide for the armor to be curved in at least one direction.

2. The armor according to claim 1, wherein at least one prismatic element comprises at least one of a groove, passageway or cavity.

3. The armor according to claim 2, wherein the at least one of explosive material, at least one computing device, at least one sensor, at least one optical fiber, at least one antenna element, and at least one electrical wire are disposed in the at least one of groove, passageway or cavity.

4. The armor according to claim 1, wherein adjacent prismatic elements within at least one of the first layer of prismatic elements and the second layer of prismatic elements comprise at least two faces adjacent to each other that define substantially aligned grooves that form a channel.

5. The armor according to claim 1, further comprising a strike face sheet and a rear face sheet, such that the core is disposed between the strike face sheet and the rear face sheet.

6. The armor according to claim 5, further comprising a viscoelastic layer disposed between at least one of the strike face sheet and the core, and the rear face sheet and the core.

7. The armor according to claim 6, wherein the viscoelastic layer comprises one or more of polyurethane, polysulfide polymer, natural rubber, silicone rubber, and a synthetic rubber.

8. The armor according to claim 6, wherein at least one prismatic element of the first layer and at least one prismatic element of the second layer are non-opaque, the strike face sheet is non-opaque, and the viscoelastic layer exhibits a refractive index corresponding to refractive indices exhibited by the non-opaque prismatic elements and the strike face sheet.

9. The armor of claim 6, wherein at least one prismatic element of the first layer and at least one prismatic element of the second layer are non-opaque, the rear face sheet is non-opaque, and the viscoelastic layer exhibits a refractive index corresponding to refractive indices exhibited by the non-opaque prismatic elements and the rear face sheet.

10. The armor of claim 1, further comprising a strain isolation layer disposed between the first layer of prismatic elements and the second layer of prismatic elements.

11. The armor according to claim 1, wherein at least one of the prismatic element of the first layer of prismatic elements and the second layer of prismatic elements is configured with a metallic layer disposed thereon.

12. The armor according to claim 1, wherein the at least one of an explosive material, at least one computing device, at least one sensor, at least one optical fiber, at least one antenna element, and at least one electrical wire comprise a smart component.

13. The armor according to claim 12, wherein the smart component enables at least one of non-structural and a non-armoring function of the armor.

14. The armor according to claim 12, wherein the smart component enables detection of at least one of a pressure change to the armor, a strain on the armor, a temperature change of the armor, accumulation of ice on the armor, a physical defect in the armor, and damage to the armor.

15. The armor according to claim 12, wherein the smart component enables at least one of cloaking, active camouflaging, signature management, structural health sensing, sensor integration, and hostile fire indicating of the armor.

16. The armor according to claim 5, wherein the at least one of explosive material, at least one computing device, at least one sensor, at least one optical fiber, at least one antenna element, and at least one electrical wire are at least one of disposed on an outer surface of the strike face sheet and the strike face sheet and wherein the at least one of explosive material, at least one computing device, at least one sensor, at least one optical fiber, at least one antenna element, and at least one electrical wire are a unitary element.

17. The armor according to claim 5, wherein the at least one of explosive material, at least one computing device, at least one sensor, at least one optical fiber, at least one antenna element, and at least one electrical wire are at least one of disposed on an outer surface of the rear face sheet and the rear face sheet and the at least one of explosive material, at least one computing device, at least one sensor, at least one optical fiber, at least one antenna element, and at least one electrical wire are a unitary element.

18. The armor according to claim 6, wherein the at least one of explosive material, at least one computing device, at least one sensor, at least one optical fiber, at least one antenna element, and at least one electrical wire are disposed between at least one of the strike face sheet and the viscoelastic layer, and the viscoelastic layer and the core.

19. An armor comprising:

a core configured with a first layer of prismatic and a second layer of prismatic elements;

a smart component operably associated with at least one of a component of the armor, at least one prismatic element of the first layer of prismatic elements and at least one prismatic element of the second layer of the prismatic elements; and wherein the first layer of prismatic elements is nested into the second layer of prismatic elements;

wherein at least one prismatic elements of the first layer of prismatic elements and the second layer of prismatic elements comprise a first base, a second base, and a plurality of faces extending between the first base and the second base;

wherein at least one of the plurality of faces is non-planar to provide for the armor to be curved in at least one direction; and wherein the smart component comprises at least one of an explosive material, at least one computing device, at least one sensor, at least one optical fiber, at least one antenna element, and at least one electrical wire.

* * * * *